US009226601B2

(12) United States Patent
Maurer

(10) Patent No.: US 9,226,601 B2
(45) Date of Patent: Jan. 5, 2016

(54) VERTICAL SHELF ASSEMBLY

(71) Applicant: Scott D. Maurer, Asheville, NC (US)

(72) Inventor: Scott D. Maurer, Asheville, NC (US)

( * ) Notice: Subject to any disclaimer, the term of this patent is extended or adjusted under 35 U.S.C. 154(b) by 0 days.

(21) Appl. No.: 13/724,755

(22) Filed: Dec. 21, 2012

(65) Prior Publication Data

US 2015/0060380 A1 Mar. 5, 2015

(51) Int. Cl.
*A47F 5/08* (2006.01)
*A47F 5/01* (2006.01)

(52) U.S. Cl.
CPC .. *A47F 5/083* (2013.01); *A47F 5/01* (2013.01)

(58) Field of Classification Search
CPC ..... A47F 5/0025; A47F 5/0031; A47F 5/05; A47F 5/08; A47F 5/0807; A47F 5/0815; A47F 5/083; A47F 5/0838; A47F 5/0846; A47F 5/0853; A47F 5/14
USPC ..... 211/54.1, 57.1, 59.1, 87.01, 90.03, 211/94.01, 169, 169.1, 181.1; 108/106–110
See application file for complete search history.

(56) References Cited

U.S. PATENT DOCUMENTS

| | | | | | |
|---|---|---|---|---|---|
| 2,850,172 | A | * | 9/1958 | Beckner | 108/107 |
| 2,970,702 | A | * | 2/1961 | Maslow et al. | 108/106 |
| 4,340,144 | A | | 7/1982 | Cousins | |
| 4,345,688 | A | * | 8/1982 | De Boer | 211/70.6 |
| 4,494,661 | A | | 1/1985 | Krusche | |
| 4,615,278 | A | | 10/1986 | Cabrelli | |
| 4,635,563 | A | | 1/1987 | Hand et al. | |
| 4,811,670 | A | | 3/1989 | Kolvites et al. | |
| 4,842,230 | A | | 6/1989 | Cobb et al. | |
| 4,890,747 | A | * | 1/1990 | Sayers | 211/106 |
| 5,038,943 | A | | 8/1991 | Reinke | |
| 5,601,038 | A | * | 2/1997 | Welch et al. | 108/193 |
| 5,769,248 | A | | 6/1998 | Johnson | |
| 5,779,065 | A | * | 7/1998 | Thalenfeld et al. | 211/87.01 |
| 5,884,567 | A | | 3/1999 | Bartz, Jr. | |
| 6,070,747 | A | * | 6/2000 | Shea | 211/87.01 |
| 6,158,600 | A | * | 12/2000 | Ferrucci et al. | 211/90.02 |

(Continued)

FOREIGN PATENT DOCUMENTS

| | | | | |
|---|---|---|---|---|
| DE | 29506701 U1 | * | 4/1995 | A47F 5/083 |
| TW | M248307 U | | 11/2004 | |
| TW | M416391 U | | 11/2011 | |

OTHER PUBLICATIONS

PCT International Search Report; PCT/US2013/00279; Maurer.

(Continued)

*Primary Examiner* — Joshua Rodden
(74) *Attorney, Agent, or Firm* — The Van Winkle Law Firm; David M. Carter; William G. Heedy

(57) ABSTRACT

A mountable article retaining system for retaining articles in a storage mode or a display mode is provided and includes a grid layout having an open wire grid and a plurality of corner assemblies secured to the open wire grid. The open wire grid has a rectilinear substantially planar suspension engagement area. The mountable article retaining system also includes a liaison component, the liaison component being securable to an external structure on which the grid layout is to be mounted and the liaison component being operable to maintain the grid layout relative to the external structure such that the rectilinear substantially planar suspension engagement area of the grid layout has a non-horizontal slope with at least one corner assembly being higher than another given corner assembly.

20 Claims, 13 Drawing Sheets

(56) References Cited

U.S. PATENT DOCUMENTS

| | | | | |
|---|---|---|---|---|
| 6,253,687 | B1 * | 7/2001 | McAllister | 108/107 |
| 6,299,001 | B1 * | 10/2001 | Frolov et al. | 211/106 |
| 6,758,355 | B2 | 7/2004 | Zidek | |
| 7,708,156 | B2 * | 5/2010 | Johnson | 211/106 |
| 2003/0192842 | A1 * | 10/2003 | Suttles | 211/87.01 |
| 2005/0279041 | A1 * | 12/2005 | Staples et al. | 52/506.06 |
| 2006/0042522 | A1 * | 3/2006 | Trubiano | 108/110 |
| 2008/0245753 | A1 | 10/2008 | Spriegel et al. | |
| 2009/0078664 | A1 * | 3/2009 | Steffan | 211/153 |
| 2009/0194492 | A1 * | 8/2009 | Brasher | 211/49.1 |
| 2010/0000449 | A1 | 1/2010 | Botkin | |
| 2011/0298346 | A1 | 12/2011 | Stone | |

OTHER PUBLICATIONS

International Searching Authority; Written Opinion of the International Searching Authority; mailed Apr. 16, 2014.

* cited by examiner

VERTICAL SHELF ASSEMBLY

BACKGROUND OF THE INVENTION

Wall mounted storage and display systems such as pegboards are commonly attached to a wall and are designed to support specially designed hooks attached to "peg" holes in the pegboard. The hooks may be used to attach or hold implements or tools in a fixed position relative to the pegboard. In reality, many conventional pegboard systems can only support a limited number of items and a limited amount of weight without damaging the pegboard. In addition, the hooks used with many conventional pegboard systems may inadvertently be removed or dislodged, which may allow items to fall and break. It is known to use fasteners to help secure the hooks to the pegboard, but these fasteners require additional time to install and often offer limited assistance in keeping the hook attached to the pegboard. Further, because pegboard is typically constructed from relatively weak materials such as fiberboard or particle board, conventional pegboard cannot support significant loads and the pegboard may fail if excessive weight is placed on the hooks.

In addition, pegboard is typically constructed from wood and is consequently often heavy. However, because the pegboard is usually constructed from thin sheets of wood, the pegboard can be brittle and easily broken. Further, if the pegboard is broken or damaged, it may be difficult and time consuming to repair. Moreover, the wood comprised in the pegboard is subject to moisture damage and often requires painting or staining to help protect the wood.

A slat wall storage and organization system typically includes a panel with a series of generally horizontal grooves or channels that run along the length of the panel, providing a slatted appearance. Typically, hooks may be selectively connected to and disconnected from the grooves, and items such as tools or implements may be placed onto the hooks for storage. The hooks may be used to support a variety of objects such as tools in a workroom or garage to products that are on display in a retail store.

Conventional slat wall systems may allow the hooks to be placed in a variety of desired positions relative to the panel. The panels of some conventional slat wall systems may be made from relatively heavy materials such as particle board, plywood, or fiberboard. This may undesirably increase the weight of the panels, which may make the panels more difficult to install and the slat wall system more expensive to store in a retail inventory or to deliver to a customer.

Slotted wall panels or pegboard panels are commercially available in sheets that are 4 feet wide by 8 feet long. The slotted wall panels are ¾ inch thick and the pegboard panels range in thickness from ⅛-¼ inch thick. The installation of slotted wall panels involves driving screws of sufficient length through the center of horizontal grooves and into structural supports of the wall. Because of the relatively heavy thickness and dense material composition of a typical slotted wall panel, relatively heavy items can be stored or merchandise items can be displayed on the accessories designed for the slotted wall panel.

SUMMARY OF THE INVENTION

A need therefore exists for a system that eliminates or diminishes the disadvantages and problems described above.

One object of the present invention is to provide a storage and organization system that may be used to store and/or organize various items. For example, the storage and organization system may include a single vertical open wire grid and various types of attachment members (which may include hooks, braces, brackets, racks, cabinets, shelves and the like) that are connected to the open wire grid.

Yet another object of the present invention is to provide a storage and organization system that may include one or more open wire grids each of which is sized and configured to receive, retain and/or engage one or more attachment members. The open wire grids may be connected to an existing wall of a structure such as a sheetrock, plaster, or masonry interior wall of a residential house or a commercial office or retail store. Alternatively, the open wire grids can be mounted on a free standing structure such as, for example, an upright self-standing furniture piece used as a closet. Moreover, the open wire grids may form a rear wall or one of the side walls of the self-standing furniture piece. Alternatively, a open wire grid may be mounted inside a larger storage structure such as a cabinet.

If desired, the open wire grid may be accessible when the doors of the cabinet are open and non-accessible when the doors of the cabinet are closed. When the doors of the cabinet are open, one or more attachment members may be selectively connected to and/or disconnected from the open wire grid.

The attachment members suitable for use with the open wire grid include numerous combinations and arrangements of attachments members having various supports, such as hooks, braces, brackets, straps, clamps, clasps, hangers, racks, baskets, bins, cabinets, shelves, rack-and-ball holders, bicycle hooks, golf-bag holders and other types of supports. The receiving portions suitable for use with the open wire grid include one or more elongated receiving portions (such as elongated slots, channels, grooves or the like) that are sized and configured to receive, retain and/or engage at least a portion of an attachment member. The receiving portions may include rows and/or columns of holes, such as in peg boards, that are sized and configured to receive, retain and/or engage at least a portion of an attachment member.

One of the suitable wall mounted assemblies for mounting a open wire grid to a wall is in the form of a liaison rail placed horizontally on the wall. The liaison rail may include a plurality of wall attachment bores spaced apart along the length of the liaison rail at specific predetermined longitudinal spacings from one another for assisting with the secure attachment of the liaison rail to an external structure. Another suitable wall mounted assembly for mounting a open wire grid to a wall is in the form of a liaison rail placed horizontally on the wall with an adapter boss provided at each location at which a corner assembly is secured to the liaison rail According to certain features of the one aspect of the present invention, there is provided a mountable article retaining system, the mountable article retaining system being operable to retain at least one article. The mountable article retaining system includes a grid layout having an open wire grid, a plurality of corner assemblies secured to the open wire grid, a lateral set of side wire pairs having a first pair of associated side wires and a second pair of associated side wires, and a longitudinal set of side wire pairs having a first pair of associated side wires and a second pair of associated side wires. Each corner assembly is connected to an end portion of a respective pair of associated side wires of the lateral set of side wires and an end portion of a respective pair of associated side wires of the longitudinal set of side wires. Also, the open wire grid has a plurality of warp wires and a plurality of weft wires in substantially the same plane and arranged in perpendicular intersecting manner with one another to delimit a rectilinear substantially planar suspension engagement area and the four sides of the rectilinear substantially planar suspension engagement area formed by the plurality of warp wires and the plurality of weft wires are secured to the lateral set of side wires and the longitudinal set of side wires. The mountable article retaining system also includes a liaison component, the liaison component being securable to an external structure on which the grid layout is to be mounted and the liaison component being operable to maintain the grid layout relative to the external structure such that the rectilinear substantially planar suspension engagement area of the grid layout has a non-horizontal slope with at least one corner assembly being higher than another given corner assembly.

In some instances, the first respective paired wire set and the second respective paired wire set together form a wire set included angle having a value of ninety degrees (90°). Also, each corner assembly may have an annular bottom rim at one axial end and an annular top rim at its opposite axial end that has a diameter smaller than the diameter of the annular bottom rim.

Still another aspect is a storage and organization system that may include a wall and a connection assembly which is used to connect a cabinet to the wall. Yet another aspect of the present invention is a modular storage and organization system that may include a wall and a plurality of cabinets that may be selectively connected to and/or disconnected from the wall. Yet another further aspect is a storage and organization system that may include one or more panels each of which is formed of an open wire grid. The panels may be interconnected by one or more connectors. A further additional aspect of the present invention is a storage and organization system that may include panels with receiving portions that are specifically sized and configured to allow attachment members to be attached. These receiving portions may allow the attachment members to be securely attached to the panels. In addition, these receiving portions may allow the attachment members to be selectively attached and removed from the panels. These receiving portions preferably allow the attachment members to be attached to various locations to the panels.

The present invention is generally directed towards storage and/or organization systems. The principles of the present invention, however, are not limited to storage and/or organization systems. It will be understood that, in light of the present disclosure, the storage and/or organization system, and its associated components and features, disclosed herein can be successfully used in connection with other types of structures, devices and uses. Additionally, to assist in the description of the storage and/or organization system, words such as top, bottom, front, rear, right and left may be used to describe the accompanying figures, which may be but are not necessarily drawn to scale. It will be appreciated that the storage and/or organization system can also be located in a variety of desired positions and/or orientations.

BRIEF DESCRIPTION OF THE DRAWINGS

Other features and advantages of the invention will become apparent to those skilled in the art upon review of the following detailed description, claims, and drawings.

DETAILED DESCRIPTION OF AN EMBODIMENT

The present invention provides a mountable article retaining system, the mountable article retaining system being operable to retain at least one article. The mountable article retaining system includes a grid layout having an open wire grid and the mountable article retaining system also includes a liaison component, the liaison component being securable to an external structure on which the grid layout is to be mounted and the liaison component being operable to maintain the grid layout relative to the external structure such that the rectilinear substantially planar suspension engagement area of the grid layout has a non-horizontal slope with at least one corner assembly being higher than another given corner assembly, a plurality of corner assemblies secured to the open wire grid, a lateral set of side wire pairs having a first pair of associated side wires and a second pair of associated side wires, and a longitudinal set of side wire pairs having a first pair of associated side wires and a second pair of associated side wires. Each corner assembly is connected to an end portion of a respective pair of associated side wires of the lateral set of side wires and an end portion of a respective pair of associated side wires of the longitudinal set of side wires. Also, the open wire grid has a plurality of warp wires and a plurality of weft wires in substantially the same plane and arranged in perpendicular intersecting manner with one another to delimit a rectilinear substantially planar suspension engagement area and the four sides of the rectilinear substantially planar suspension engagement area formed by the plurality of warp wires and the plurality of weft wires are secured to the lateral set of side wires and the longitudinal set of side wires.

The supported items can be any desired item such as, for example, a shelf, a pivoting shelf door, or a support hook.

Figure 1:
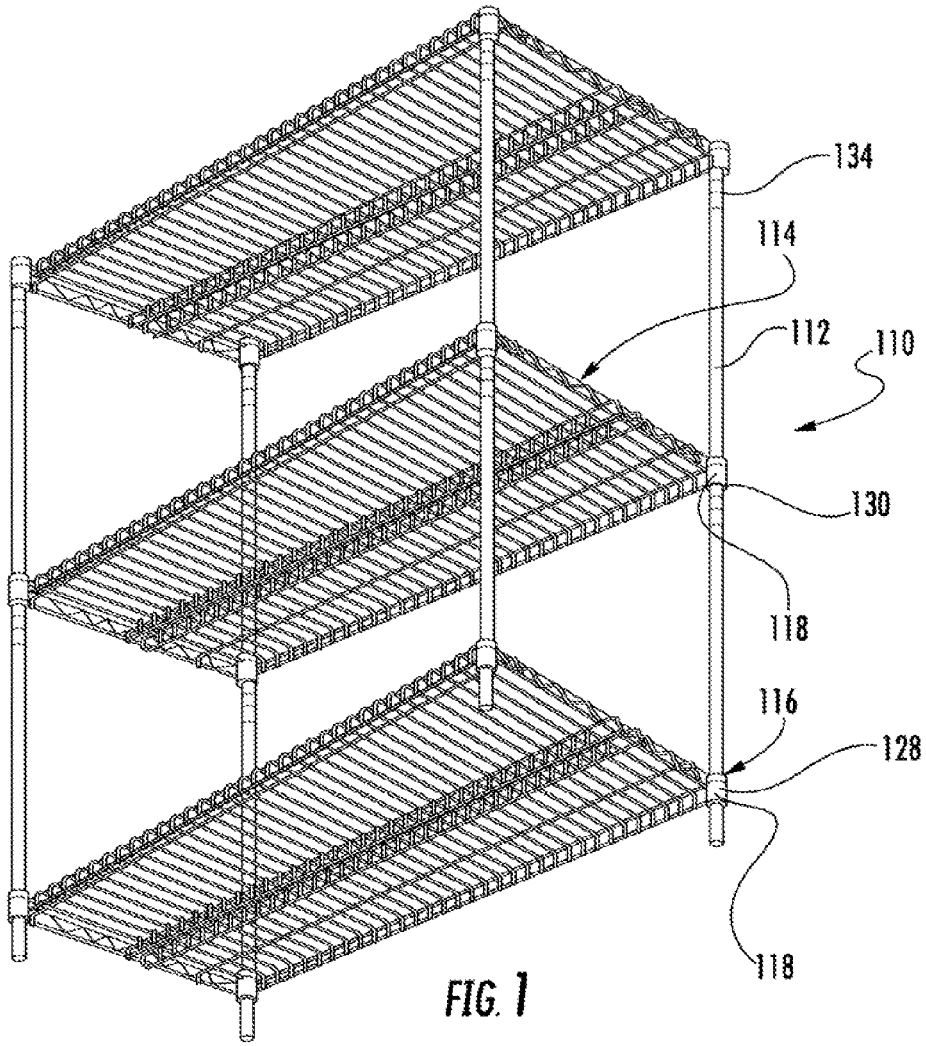
FIG. 1 is a perspective view of a representative self standing shelf assembly that comprises several open wire grid units.
Figure 2:
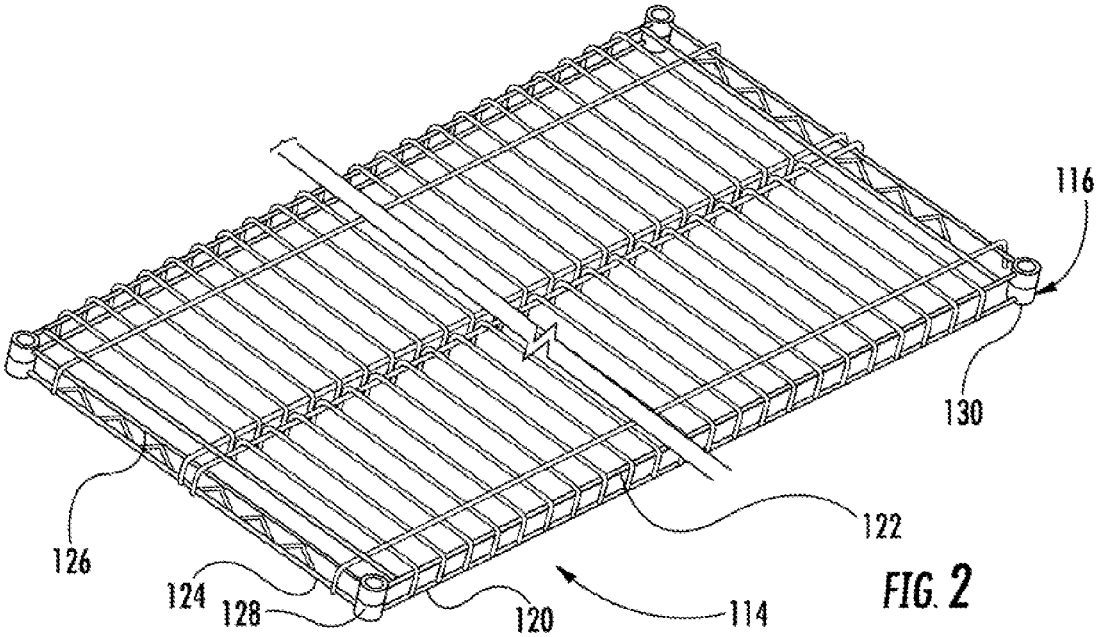
FIG. 2 is a perspective view of an individual rack of the representative self standing shelf assembly shown in FIG. 1.

One configuration of the mountable article retaining system advantageously deploys an open wire grid that has been commercially available as a component of certain self standing shelf assemblies. Moreover, the mountable article retaining system may be deployed in combination with certain self standing shelf assemblies to increase or enhance the storage and/or display capabilities of these self standing shelf assemblies. Thus, to facilitate an understanding of the mountable article retaining system, reference will be had initially to a representative self standing shelf assembly that provides a structure for conveniently storing items and which comprises several open wire grid units. As seen in FIG. 1, which is a perspective view of a representative self standing shelf assembly that comprises several open wire grid units, a rack 110 has a plurality of vertical posts—specifically, a total of four (4) posts 112—and a plurality of racks 114 connected to the posts 112. Each rack 114 includes a corner assembly 116 secured to the rack via, for example, welds 118. As seen in FIG. 2, which is a perspective view of an individual rack 114, each of the racks 114 is formed with several open wire grid units each delimited by two parallel wires 120 and 122 in the front and a pair of side wires 124 and 126. Each of the wires 120, 122, 124 and 126 are welded as indicated to a respective corner support member 128 comprised in a respective corner assembly 116. Each corner assembly 116 also includes an insert member 130 integrally molded from a suitable material, such as, for example, nylon, or another hard, moldable plastic material. Each post 112 has a plurality of radially inwardly extending grooves 134 disposed at uniform axial spacings from one another.

Figure 4:
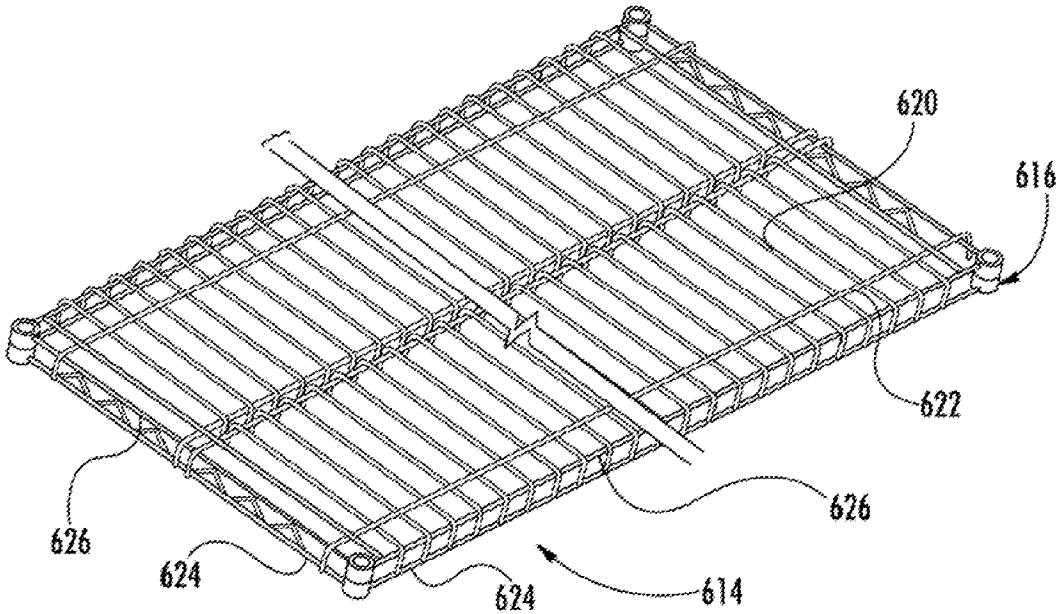
FIG. 4 is a bottom perspective view of the portion of the open wire grid and corner assemblies of the one embodiment of the mountable article retaining system shown in FIG. 3.
Figure 3:
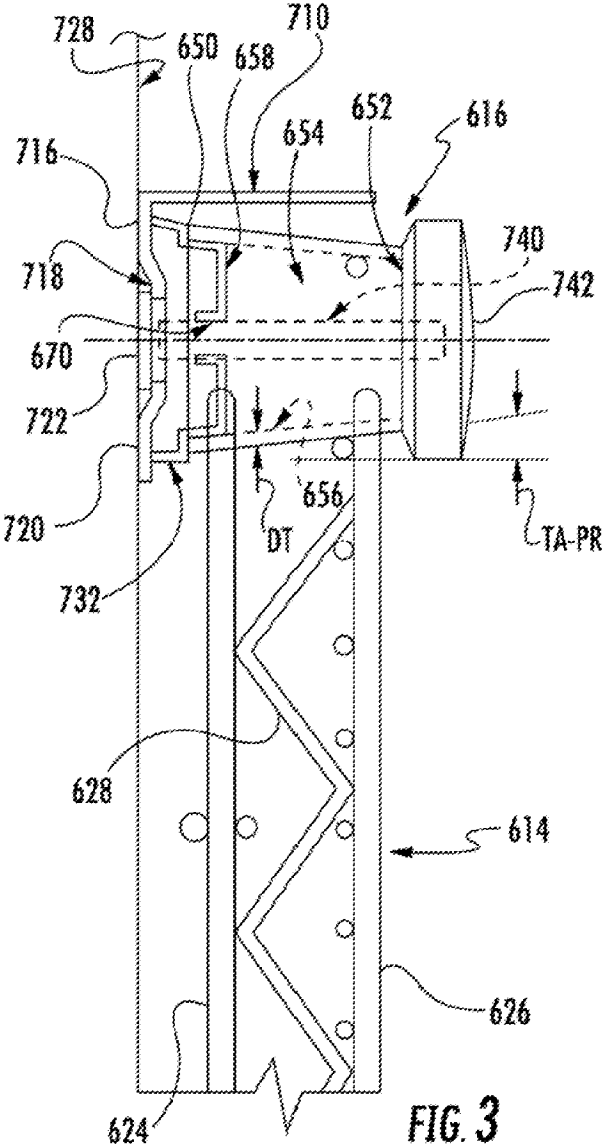
FIG. 3 is a side elevational view of a portion of one embodiment of the mountable article retaining system that is particularly advantageously adapted for retaining articles on an external structure such as a wall or a door.
Figure 12:
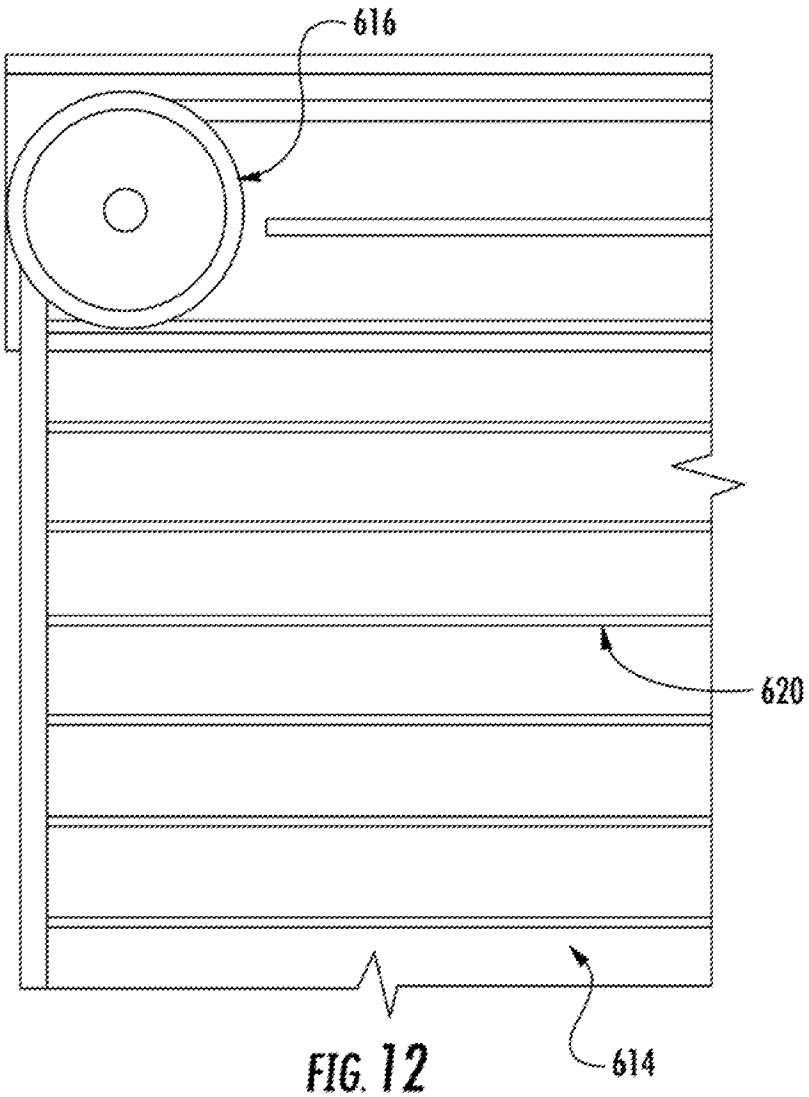
FIG. 12 is a front elevational view of the open wire grid and the corner assembly of the one embodiment of the mountable article retaining system shown in FIG. 3

Having described a self standing shelf assembly with which the mountable article retaining system can be deployed in combination, a description will now be provided of the mountable article retaining system which itself deploys an open wire grid having similarities to the open wire grid units described in connection with the self standing shelf assembly shown in FIGS. 1 and 2. However, before describing a version of the mountable article retaining system that can be deployed in combination with a self standing shelf assembly, a description will initially be provided of another version of the mountable article retaining system that is particularly adapted for retaining articles on an external structure different than a self standing shelf assembly and is particularly advantageously adapted for retaining articles on an external structure such as a wall or a door. As seen in FIG. 3, which is a side elevational view of a portion of one embodiment of the mountable article retaining system that is particularly advantageously adapted for retaining articles on an external structure such as a wall or a door, this embodiment of the mountable article retaining system is generally designated as the mountable article retaining system 610 and includes a grid layout having an open wire grid and a liaison component. The mountable article retaining system 610 has a vertical open wire grid 614 and a total of four (4) corner assemblies 616 secured to the grid 614. As seen in FIG. 4, which is a bottom perspective view of the portion of the open wire grid and corner assemblies of the one embodiment of the mountable article retaining system shown in FIG. 3, and as seen in FIG. 12, which is a front elevational view of the open wire grid and the corner assembly of the one embodiment of the mountable article retaining system shown in FIG. 3, the grid 614 is formed as an open wire grid having a plurality of warp wires 620 and a plurality of weft wires 622 in substantially the same plane and arranged in perpendicular intersecting manner with one another to delimit a rectilinear substantially planar suspension engagement area. Each of the four sides of the rectilinear substantially planar suspension engagement area formed by the plurality of warp wires 620 and the plurality of weft wires 622 is secured to a respective pair of paired bottom side wires 624 and upper side wires 626. Thus, there is a lateral set of side wire pairs having a first pair of associated side wires and a second pair of associated side wires and a longitudinal set of side wire pairs having a first pair of associated side wires and a second pair of associated side wires. Also, each corner assembly is connected to an end portion of a respective pair of associated side wires of the lateral set of side wires and an end portion of a respective pair of associated side wires of the longitudinal set of side wires.

A respective one of the pair of the bottom side wire 624 is interconnected to a respective one of the pair of upper side wires 626 via a serpentine support truss 628. Bottom side wire 626 runs from a point near, but not at, the top of the respective corner assembly 616 shown in FIG. 3 to an analogous point on a respective other corner assembly 616 (not shown in FIG. 3). The upper side wire 624 runs from the bottom of the respective corner assembly 616 shown in FIG. 3 to an analogous point on a respective other corner assembly 616 (not shown in FIG. 3). Bottom side wire 626 and the upper side wire 624 are securely welded to the noted pair of corner assemblies 616. To ensure that the bottom side wire 626 and the upper side wire 624 remain substantially parallel each other even under stress and high load conditions, the serpentine support truss 628 is attached via welding to the bottom side wire 626 and the upper side wire 624. The serpentine support truss 628 is secured in a manner in which each top apex is welded to the inside of the bottom side wire 626 and each bottom apex is welded to the inside of the upper side wire 624. In practice, the serpentine support truss 628 ensures an equal distance between the bottom side wire 626 and the upper side wire 624 and ensures that they remain parallel, or substantially parallel, to each other even under loaded conditions.

Figure 5:
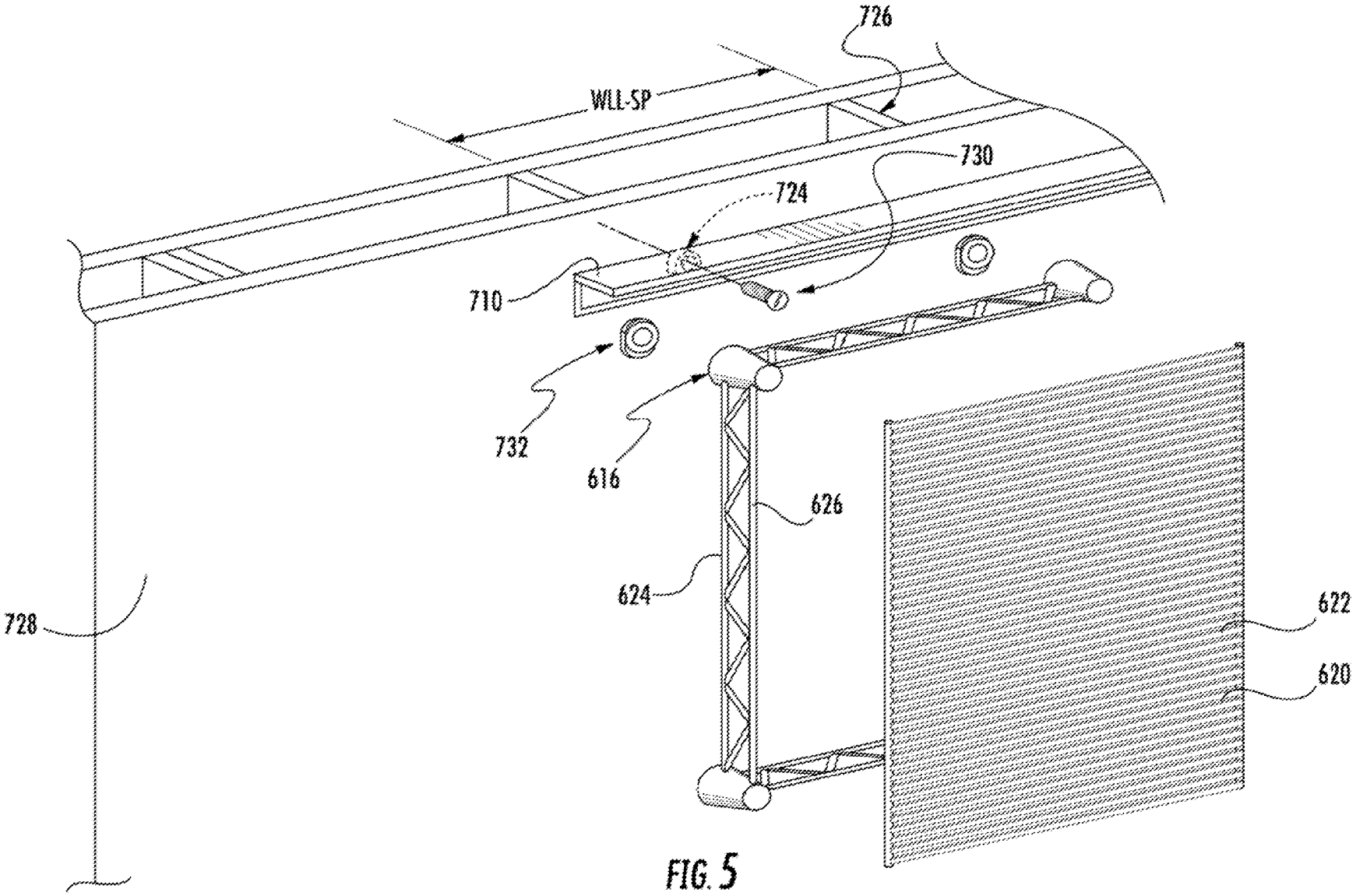
FIG. 5 is an exploded perspective view of the mountable article retaining system mounted on an external structure in the form of a vertical wall.
Figure 6:
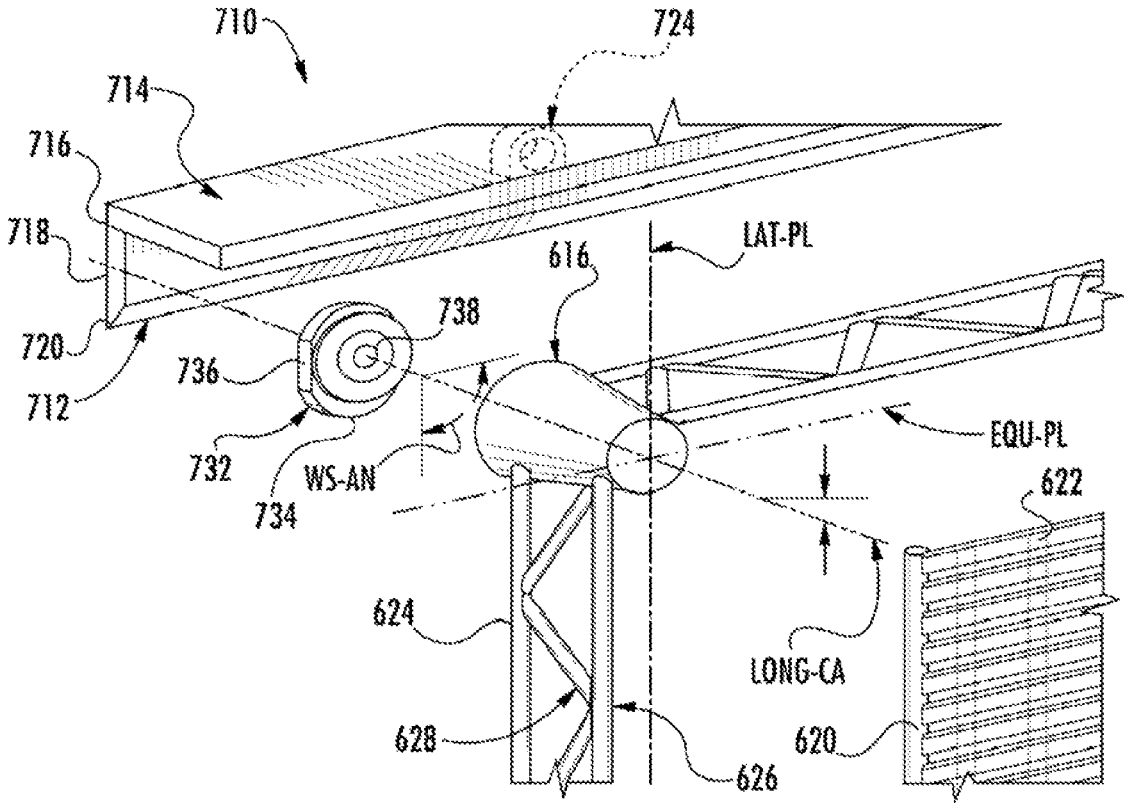
FIG. 6 is an enlarged perspective view of a portion of the mountable article retaining system shown in FIG. 5.

Reference is now had to FIG. 5, which is an exploded perspective view of the mountable article retaining system mounted on an external structure in the form of a vertical wall, and to FIG. 6, which is an enlarged perspective view of a portion of the mountable article retaining system shown in FIG. 5. Each of the corner assemblies 616 is similarly configured in that each has fixedly connected thereto a first paired wire set having a paired upper side wire 626 and a bottom side wire 626 (interconnected to one another via a serpentine support truss 628) and a second paired wire set having a paired upper side wire 626 and a bottom side wire 626 (interconnected to one another via a serpentine support truss 628). For illustration purposes, a single corner assembly 616 and its securement to the liaison rail 710 will now be described in detail, it being understood that the other corner assemblies 616 are similarly configured and attached to a respective liaison rail 710. Each of the paired upper side wire 626 and the bottom side wire 626 of the first paired wire set is connected via, for example, welding, to the corner assembly 616 at locations along the conical periphery of the corner assembly 616 within a first lateral hemi-sphere of the corner assembly 616 delimited by a cone lateral plane LAT-PL extending through the longitudinal axis LONG—CA of the corner assembly 616 mid-point of the corner assembly 616 and perpendicular to an equator plane EQU-PL of the corner assembly 616. Each of the paired upper side wire 626 and the bottom side wire 626 of the second paired wire set is connected via, for example, welding, to the corner assembly 616 at locations along the conical periphery of the corner assembly 616 within a second lateral hemi-sphere of the corner assembly 616 delimited by the cone lateral plane LAT-PL. The first paired wire set and the second paired wire set together form a wire set included angle WS-AN having a value of ninety degrees, although the two paired wire sets may be oriented at any desired orientation relative to one another that is greater or lesser than ninety degrees.

The corner assembly 616, as seen in particular in FIG. 3, has an annular bottom rim 650 at one axial end and an annular top rim 652 at its opposite axial end that has a diameter smaller than the diameter of the annular bottom rim 650. The annular bottom rim 650 and the annular top rim 652 form the axial ends of a conical outer surface 654 of the corner assembly 616. Thus, the corner assembly 616 has a frusto-conical overall shape. The corner assembly 616 had a conical inner surface 656 that is co-extensive with its conical outer surface 654 and at a uniform spacing therefrom, whereupon the conical inner surface 656 and the conical outer surface 654 together delimit a thickness DT of the corner assembly 616.

As seen in FIG. 3, the corner assembly 616 has a base plate 658 that is secured to the conical inner surface 656 at the location of the annular bottom rim 650. The base plate 658 has a threaded center bore 670 co-axial with the longitudinal axis LONG—CA of the corner assembly 616.

As seen in FIG. 6 and FIG. 3, the liaison rail 710 has an attachment panel 712 and a reinforcement panel 714 extending perpendicularly from the attachment panel 712 and secured to a longitudinal top edge portion 716 of the attachment panel 712. The attachment panel 712 has an offset center portion 718 that extends intermediate to, and is connected to, the longitudinal top edge portion 716 and a longitudinal bottom edge portion 720. The offset center portion 718 of the liaison rail 710 is provided with a plurality of tapped bores 722 each of which has one open end and a threaded inner surface. As seen in FIG. 5, the offset center portion 718 of the liaison rail 710 also includes a plurality of wall attachment bores 724 that may be spaced apart along the length of the liaison rail 710 at specific predetermined longitudinal spacings WLL—SP from one another so that at least one of the wall attachment bores 724 will align with a wall stud 726 of a structure wall 728 to provide the liaison rail 710 with secure attachment to the structure wall 728. Fasteners such as nails or screws such as, for example, a wood screw 730, may extend through the wall attachment bores 724 and be threadingly engaged with the structure wall 728 to secure the liaison rail 710 to the structure wall. To this end, the wall attachment bores 724 may be spaced at uniform intervals from one another that measure from about 1 inch (2.54 cm) to about 1.5 inches (3.81 cm) apart. This arrangement would thus provide a range of attachment spacing options for securing the liaison rail 710 to a structure wall 728 having a plurality of wall studs 726 at center-to-center spacings of between 18 and 24 inches.

An adapter boss 732 is provided at each location at which a corner assembly 616 is secured to the liaison rail 710. The adapter boss 732 includes a pedestal base 734 having a shaped notch 736 that is configured in correspondence with the offset center portion 718 of the liaison rail 710 such this shaped notch engages the offset center portion 718 of the liaison rail 710 to fix the pedestal base 734 of the adapter boss 732 in a non-rotating disposition relative to the offset center portion 718 of the liaison rail 710. The adapter boss 732 includes a center axis through bore 738. The pedestal base 734 of the adapter boss 732 is of a larger diameter than the annular bottom rim 650 of the corner assembly 616 and the pedestal base 734 is operable to be in abutting engagement with the annular bottom rim 650 of the corner assembly 616 when the adapter boss 732 is disposed intermediate the corner assembly 616 and the liaison rail 710. A fastening bolt 740 has a cap 742 compatibly configured with respect to the annular top rim 652 of the corner assembly 616 such that the cap 742 extends slightly radially outwardly beyond the annular top rim 652 when the fastening bolt 740 (*a*) extends through, and threadingly engages, the threaded center bore 670 of the base plate 658 of the corner assembly 616, (b) extends through the center axis through bore 738 of the adapter boss 732, and (c) threadingly engages the tapped bore 722 of the liaison rail 710. The fastening bolt 740 thus ensures the fixed interconnection of the corner assembly 616 to the liaison rail 710 and its cap 742 presents an aesthetically pleasing façade on the corner assembly 616.

Figure 17A:
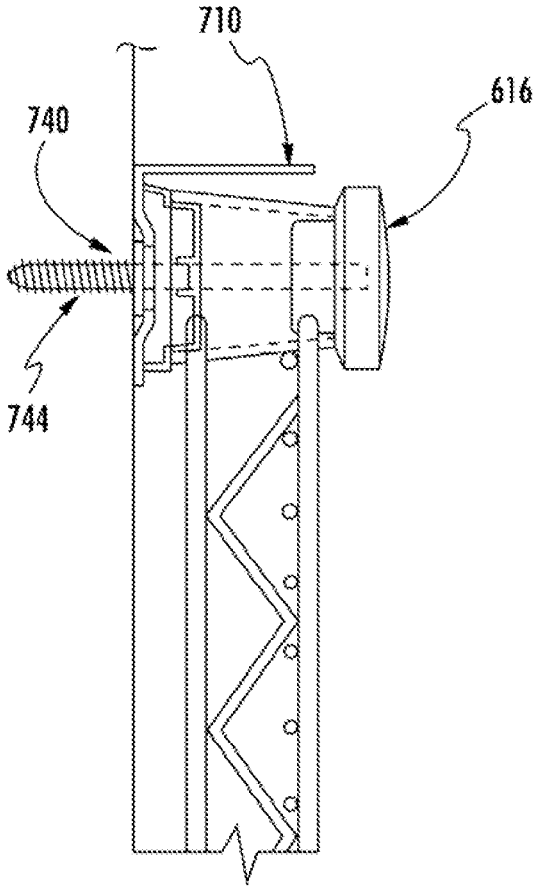
FIG. 17A is a side elevational view of the portion of one embodiment of the mountable article retaining system shown in FIG. 3 with a fastening bolt in the form of a lag bolt.
Figure 17B:
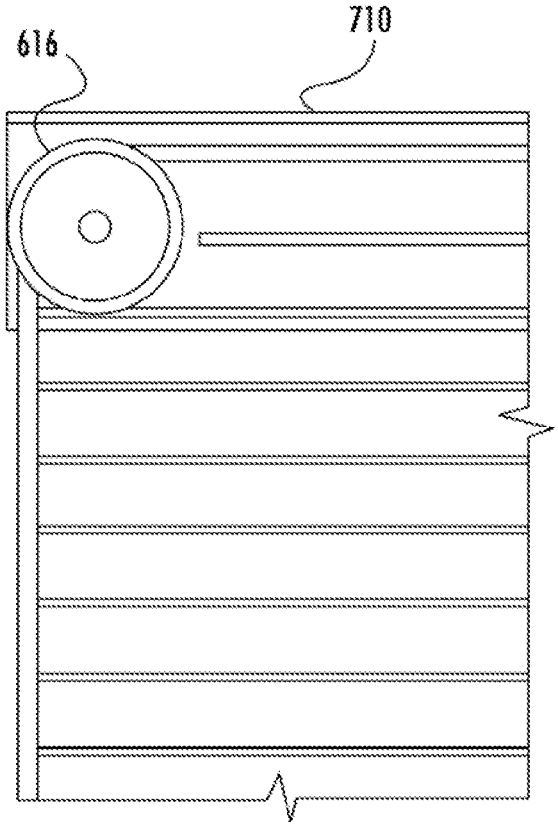
FIG. 17B is a front elevational view of the open wire grid and the corner assembly of the one embodiment of the mountable article retaining system shown in FIG. 17A.

As seen in FIG. 17A, which is a side elevational view of the portion of one embodiment of the mountable article retaining system shown in FIG. 3 with a fastening bolt in the form of a lag bolt, and as seen in FIG. 17B, which is a front elevational view of the open wire grid and the corner assembly of the one embodiment of the mountable article retaining system shown in FIG. 17A, the fastening bolt 740 can be in the form of a lag bolt having a tapered threaded end portion 744 with this tapered threaded end portion 744 extending axially beyond the tapped bore 722. The tapered threaded end portion 744 of the lag bolt is configured to threadingly engage, for example, the wall stud 726 of the structure wall 728 to provide the liaison rail 710 with secure attachment to the structure wall 728. Thus, it can be understood that configuring the fastening bolt 740 in the form of a lag bolt having a tapered threaded end portion provides the additional benefit of an further fastening location at which the mountable article retaining system 610 is secured to the structure wall 728 in addition to the securement of the liaison rail 710 itself to the structure wall 728.

Figure 7:
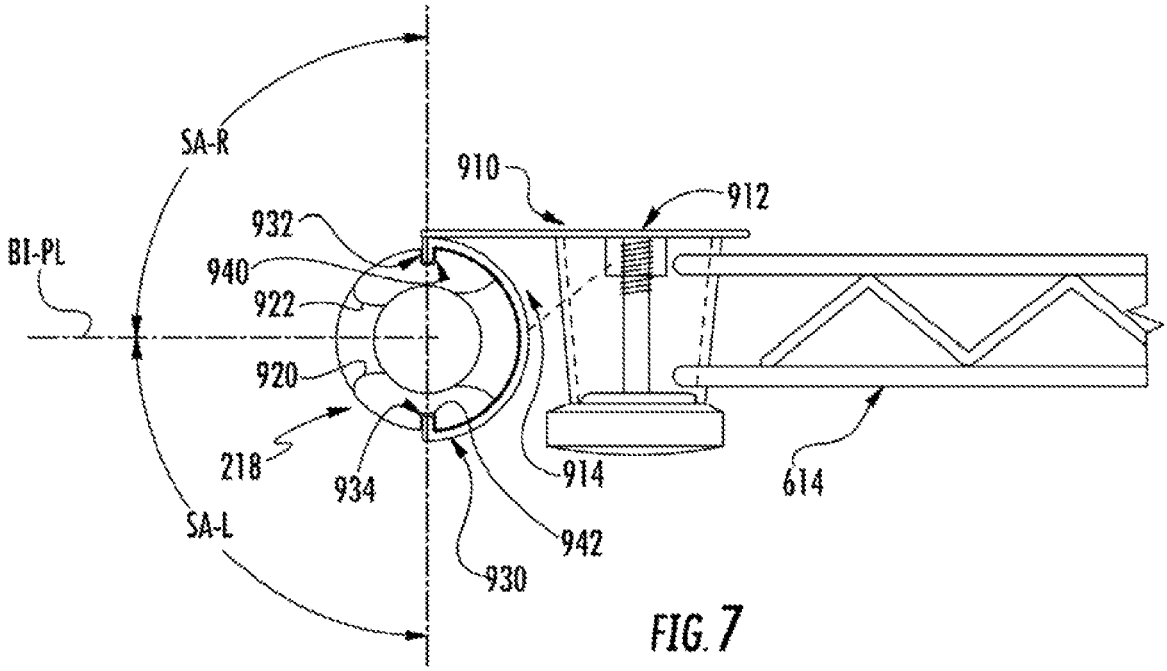
FIG. 7 is an enlarged top plan view of a support post of a self standing shelf assembly having the one version of the mountable article retaining system secured thereto.
Figure 8:
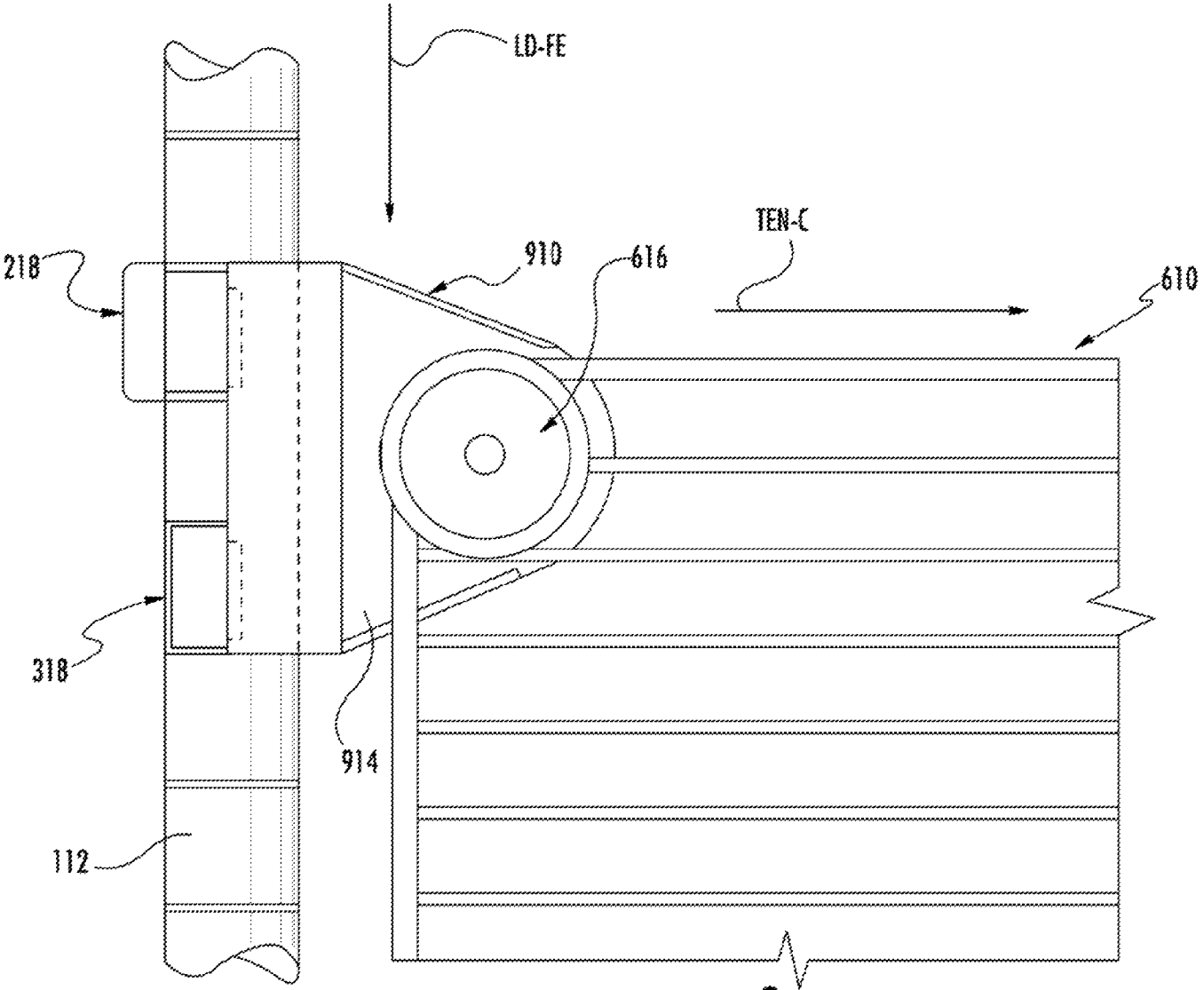
FIG. 8 is a front elevational view of the shelf assembly shown in FIG. 7.

Now a description will be provided of a version of the mountable article retaining system that can be deployed in combination with a self standing shelf assembly with reference to FIG. 7, FIG. 8, FIG. 9, and FIG. 10. As seen in FIG. 7, which is an enlarged top plan view of a support post of a self standing shelf assembly having the one version of the mountable article retaining system secured thereto, the shelf assembly 210 includes the gap sleeve 218, the gap sleeve 318, and a right angle conversion arm 910. As seen in FIG. 8, which is a front elevational view of the shelf assembly shown in FIG. 7, the right angle conversion arm 910 includes a yoke 930 having a semi-cylindrical body extending between a radially inwardly extending vertical rib 932 and a radially inwardly extending vertical rib 934. The right angle conversion arm 910 includes a mounting plate 912 rigidly secured to the yoke 930 at a predetermined angular location of the semi-cylindrical body of the yoke 930 and extending radially outwardly therefrom. As seen in FIG. 8, in the installed disposition of the shelf assembly 210, the vertical rib 932 of the yoke 930 is received in a longitudinal slot on the gap sleeve 218 that forms an attachment location 940 and this attachment location 940 is at an angular spacing SA-R from the bisecting plane BI-PL equal to ninety degrees (90°). The vertical rib 934 of the yoke 930 is received in a longitudinal slot on the gap sleeve 218 that forms an attachment location 942 and this attachment location 942 is at an angular spacing SA-L from the bisecting plane BI-PL equal to ninety degrees (90°). The right angle conversion arm 910 includes a reinforcing arm 914 that extends between and is fixedly secured to the mounting plate 912 and the yoke 930.

As seen in FIG. 8, the angular gap SL-GAP of the gap sleeve 218 is diametrically oppositely oriented relative to the angular gap SL-GAP of the gap sleeve 318 in the version of the shelf assembly 210. As seen in FIG. 7 and FIG. 8, when articles are supported on the open grid vertical rack, this creates a vertical loading force LD-FE on the right angle conversion arm 910 and a radial component TEN-C of this loading force LD-FE acts on the vertical ribs 932, 934 of the yoke 930 of the gap sleeve 218 to urge these vertical ribs to move in a direction parallel to the bisecting plane Bi-PL toward the right angle conversion arm 910. In turn, the vertical ribs 932, 934 of the yoke 930 of the gap sleeve 218 exert forces on the attachment locations 940, 942 that urge the angular ends 920, 922 of the gap sleeve 218 angularly toward one another, whereupon the seating of the gap sleeve 218 on the post 112 is maintained in a stable manner.

Figure 9:
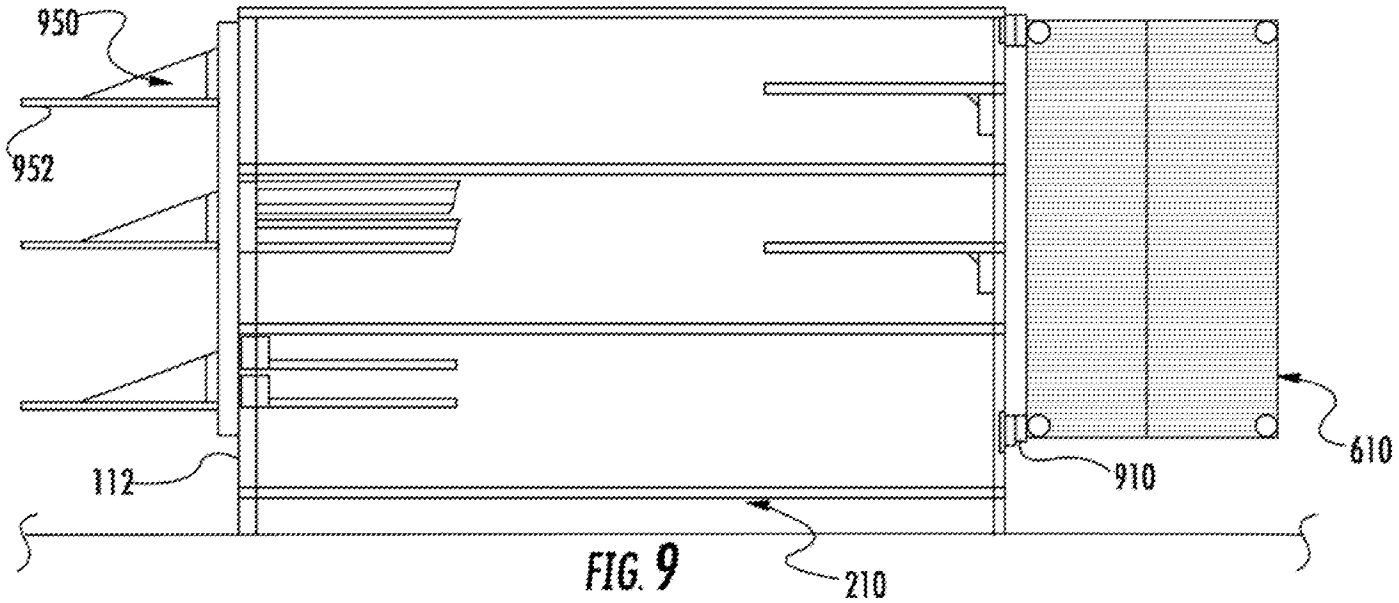
FIG. 9 is a front elevational view of the self standing shelf assembly having the one version of the mountable article retaining system secured thereto.
Figure 10:
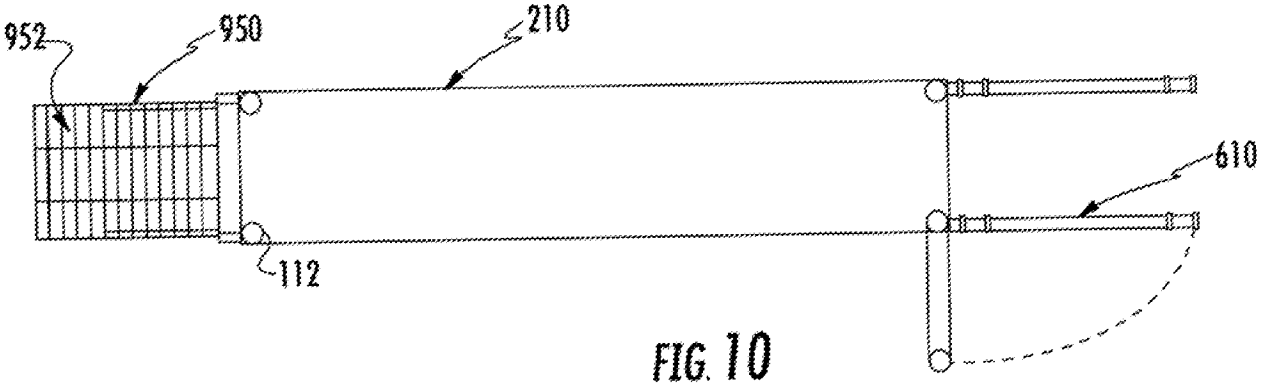
FIG. 10 is a top plan view of the shelf assembly shown in FIG. 9.

The mountable article retaining system 610 can be mounted to the right angle conversion arm 910 via a unit of the corner assembly 616 in that the right angle conversion arm 910 can be provided with a tapped or threaded bore into which the fastening bolt 740 can be threadingly secured. As seen in FIG. 9, which is a front elevational view of the self standing shelf assembly having the one version of the mountable article retaining system secured thereto, it can be seen that the mountable article retaining system 610 is secured to a front support post 112 of the self standing shelf assembly 210 via a pair of the right angle conversion arms 910 that are vertically spaced from one another such that one of the right angle conversion arms 910 engages a lower corner assembly 616 of the mountable article retaining system 610 and the other of the right angle conversion arms 910 engages an upper corner assembly 616 of the mountable article retaining system 610. Moreover, as seen in FIG. 10, which is a top plan view of the shelf assembly shown in FIG. 9, it can be seen that the pair of the right angle conversion arms 910 are secured to the post 112 of the self standing shelf assembly 210 with a capability to rotate about the post, whereupon the mountable article retaining system 610 can be rotated from a front facing display or storage position, as shown in FIG. 9, to a side facing display or storage position, as shown in the broken line depiction of the mountable article retaining system 610 in FIG. 10.

The right angle conversion arm 910 can be alternatively configured to permit the right angle conversion arm 910, when paired with another right angle conversion arm 910, to support a horizontally oriented open wire grid. Each one of a pair of bracket braces 950 has an overall triangular shape and has a connection point for fixedly connecting the bracket brace to a respective one of the alternatively configured right angle conversion arms 910. An open wire grid 952 that delimits a rectilinear substantially planar suspension engagement area is secured via, for example, welding, to the bracket braces 950. As seen in FIG. 9, which depicts three units of paired alternatively configured right angle conversion arms 910 and the respective open wire grids secured thereto, these arrangements increase the storage or display capability of the shelf assembly 210 and can be mounted at a predetermined height along the support posts 112 of the shelf assembly 210.

Figure 18A:
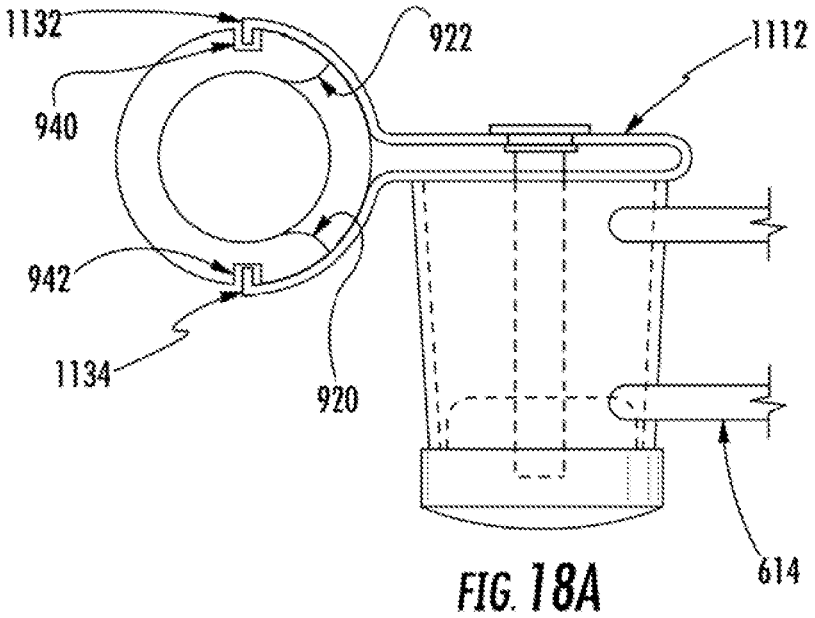
FIG. 18A is an enlarged top plan view of a support post of a self standing shelf assembly having the further alternate version of the mountable article retaining system secured thereto.
Figure 18B:
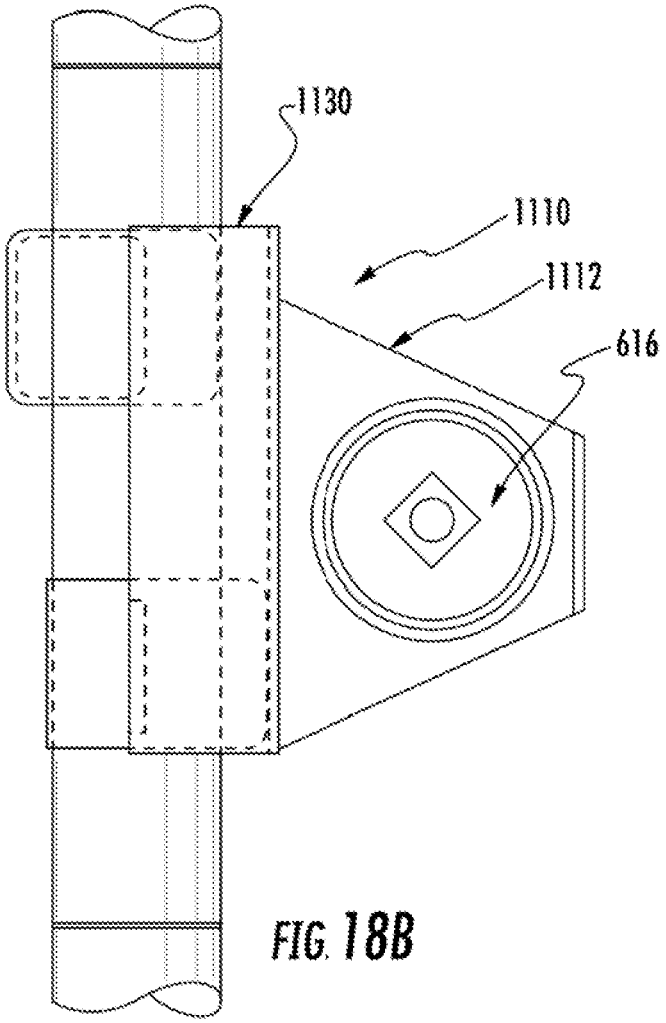
FIG. 18B is a front elevational view of the shelf assembly shown in FIG. 18A.

Reference is now had to FIG. 18A and FIG. 18B for a description of a further alternate version of the mountable article retaining system that can be deployed in combination with a self standing shelf assembly. As seen in FIG. 18A, which is an enlarged top plan view of a support post of a self standing shelf assembly having the further alternate version of the mountable article retaining system secured thereto, the shelf assembly 210 includes the gap sleeve 218, the gap sleeve 318, and a right angle conversion arm 1110. As seen in FIG. 18B, which is a front elevational view of the shelf assembly shown in FIG. 18A, the right angle conversion arm 1110 includes a yoke 1130. As seen in FIG. 18A, the yoke 1130 has a semi-cylindrical body extending between a radially inwardly extending vertical rib 1132 and a radially inwardly extending vertical rib 1134. The right angle conversion arm 1110 includes a double sided mounting plate 1112 rigidly secured to the yoke 1130 at a predetermined angular location of the semi-cylindrical body of the yoke 1130 and extending radially outwardly therefrom. As seen in FIG. 18A, in the installed disposition of the shelf assembly 210, the vertical rib 1132 of the yoke 1130 is received in the longitudinal slot on the gap sleeve 218 that forms the attachment location 940 and this attachment location 940 is at an angular spacing SA-R from the bisecting plane BI-PL equal to ninety degrees (90°). The gap sleeve 218 is deployed in connection with the further alternative version shown in FIG. 18A and FIG. 18B such that its angular ends 920, 922 are located within the hemispherical half of the gap sleeve 218 adjacent the right angle conversion arm 1110, whereas, in contrast, in connection with the version described with respect to FIGS. 7 and 8, the angular ends 920, 922 of the gap sleeve 218 are located within the respective hemispherical half of the gap sleeve 218 that is not adjacent the right angle conversion arm 1110. The vertical rib 1134 of the yoke 1130 is received in the longitudinal slot on the gap sleeve 218 that forms the attachment location 942 and this attachment location 942 is at an angular spacing SA-L from the bisecting plane BI-PL equal to ninety degrees (90°).

As seen in FIG. 18A and FIG. 18B, when articles are supported on the open grid vertical rack, this creates a vertical loading force on the right angle conversion arm 1110 and a radial component of this loading force acts on the vertical ribs 1132, 1134 of the yoke 1130 of the gap sleeve 218 to urge these vertical ribs to move in a direction parallel to the bisecting plane Bi-PL toward the right angle conversion arm 1110. In turn, the vertical ribs 1132, 1134 of the yoke 1130 of the gap sleeve 218 exert forces on the attachment locations 940, 942 that urge the angular ends 920, 922 of the gap sleeve 218 angularly toward one another, whereupon the seating of the gap sleeve 218 on the post 112 is maintained in a stable manner.

Figure 19A:
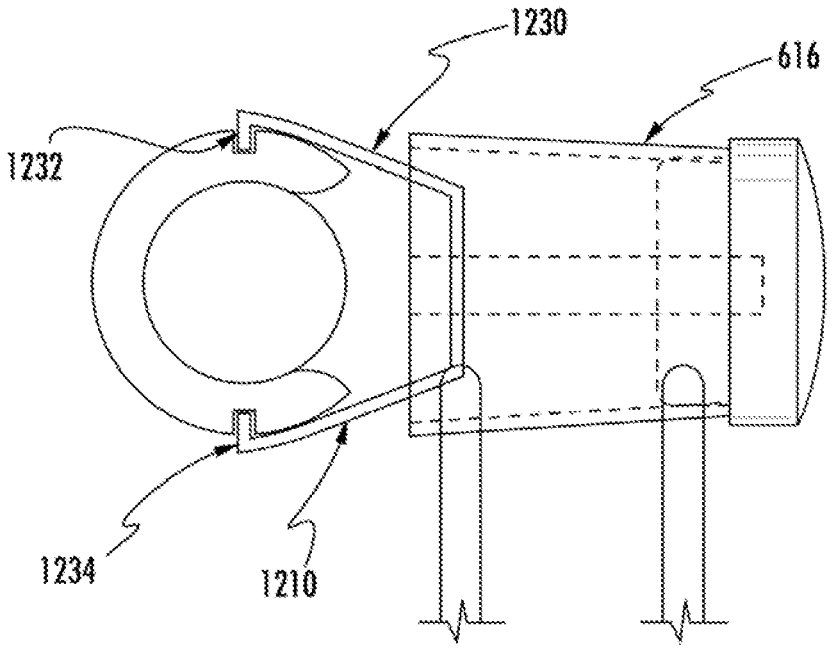
FIG. 19A is an enlarged top plan view of a support post of a self standing shelf assembly having the one version of the mountable article retaining system secured thereto.
Figure 19B:
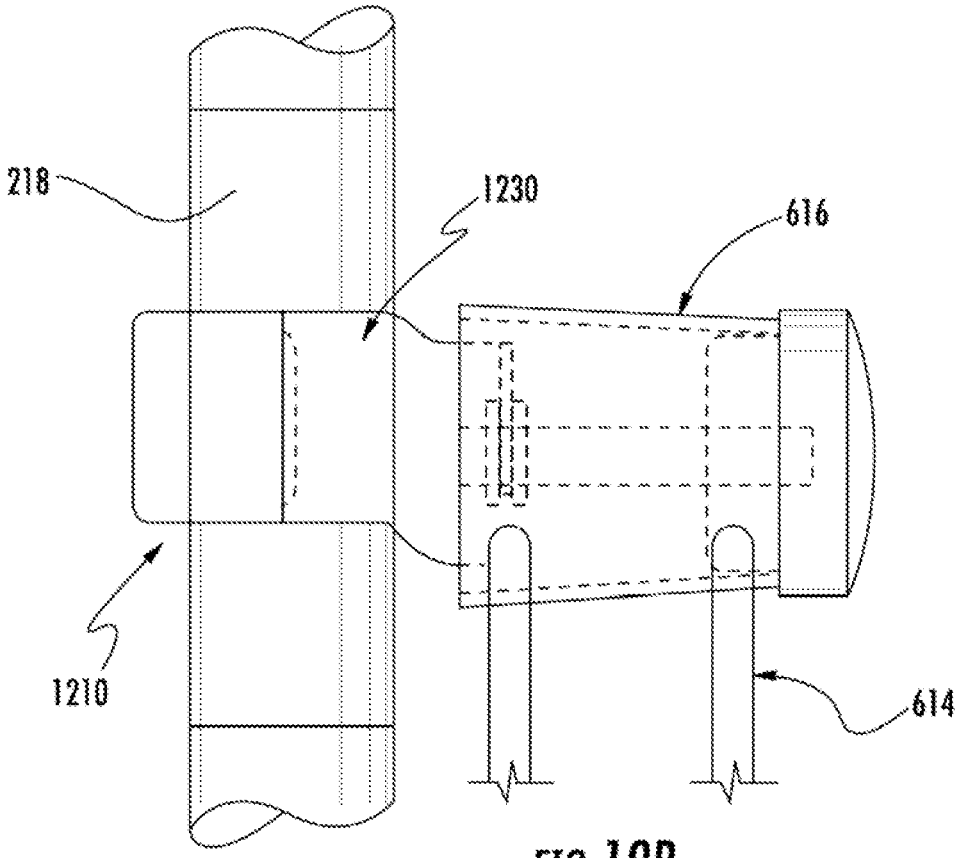
FIG. 19B is a front elevational view of the shelf assembly shown in FIG. 19A.

Reference is now had to FIG. 19A and FIG. 19B for a description of an additional variation of the mountable article retaining system that can be deployed in combination with a self standing shelf assembly. As seen in FIG. 19A, which is an enlarged top plan view of a support post of a self standing shelf assembly having the one version of the mountable article retaining system secured thereto, the shelf assembly 210 includes the gap sleeve 218, the gap sleeve 318, and a low profile conversion arm 1210. As seen in FIG. 19B, which is a front elevational view of the shelf assembly shown in FIG. 19A, the low profile conversion arm 1210 includes a yoke 1230 having a bore hole for receiving a bolt therein to thereby secure a respective corner assembly 616 to the low profile conversion arm 1210. As seen in FIG. 19A, the yoke 1230 has a three-sided body extending between a radially inwardly extending vertical rib 1232 and a radially inwardly extending vertical rib 1234. As seen in FIG. 19A, in the installed disposition of the shelf assembly 210, the vertical rib 1232 of the yoke 1230 is received in the longitudinal slot on the gap sleeve 218 that forms the attachment location 940 and this attachment location 940 is at an angular spacing SA-R from the bisecting plane BI-PL equal to ninety degrees (90°). The gap sleeve 218 is deployed in connection with the additional variation shown in FIG. 19A and FIG. 19B such that its angular ends 920, 922 are located within the hemispherical half of the gap sleeve 218 adjacent the low profile conversion arm 1210, whereas, in contrast, in connection the version described with respect to FIGS. 7 and 8, the angular ends 920, 922 of the gap sleeve 218 are located within the respective hemispherical half of the gap sleeve 218 that is not adjacent the low profile conversion arm 1210. The vertical rib 1234 of the yoke 1230 is received in the longitudinal slot on the gap sleeve 218 that forms the attachment location 942 and this attachment location 942 is at an angular spacing SA-L from the bisecting plane BI-PL equal to ninety degrees (90°).

As seen in FIG. 19A and FIG. 19B, when articles are supported on the open grid vertical rack, this creates a vertical loading force on the low profile conversion arm 1210 and a radial component of this loading force acts on the vertical ribs 1232, 1234 of the yoke 1230 of the gap sleeve 218 to urge these vertical ribs to move in a direction parallel to the bisecting plane Bi-PL toward low profile conversion arm 1210. In turn, the vertical ribs 1232, 1234 of the yoke 1230 of the gap sleeve 218 exert forces on the attachment locations 940, 942 that urge the angular ends 920, 922 of the gap sleeve 218 angularly toward one another, whereupon the seating of the gap sleeve 218 on the post 112 is maintained in a stable manner.

Figure 20:
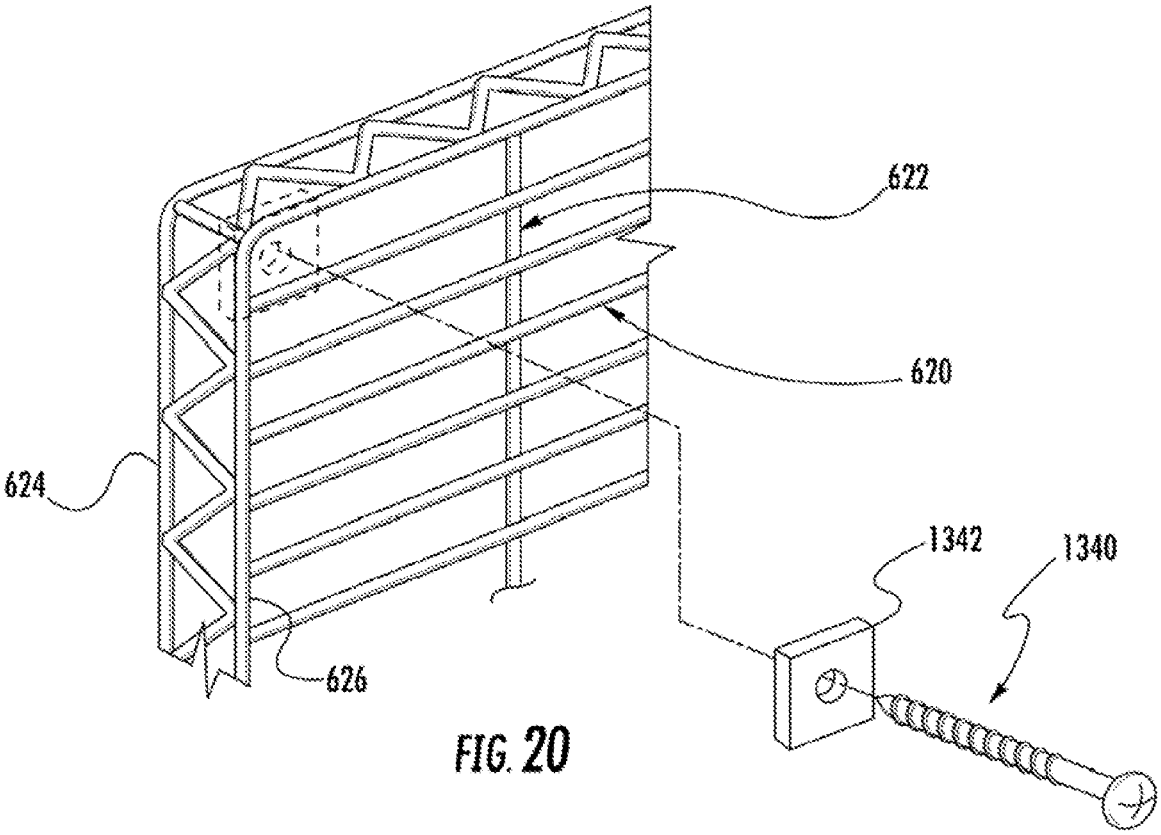
FIG. 20 is a front perspective view of a portion of a further additional embodiment of the mountable article retaining system.
Figure 21:
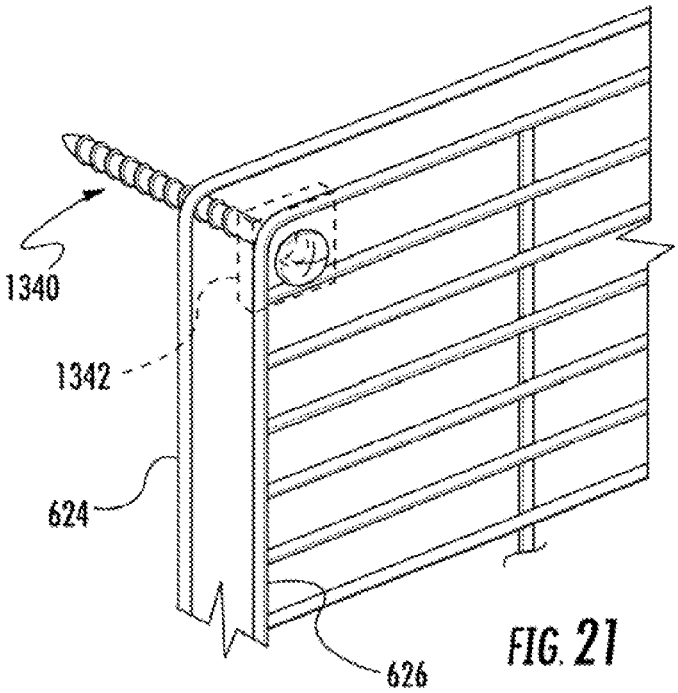
FIG. 21 is a front perspective view of the portion of the further additional embodiment of the mountable article retaining system shown in FIG. 20 in its installed disposition.

Various configurations of the mountable article retaining system of the present invention have been described whereupon the mountable article retaining system is mounted on an external structure via various arrangements in engagement with one or more of the corner assemblies 616 of the mountable article retaining system. Additionally, it is also contemplated that the mountable article retaining system can be comprised of an open wire grid that does not include a separate structure at the corners such as the tapered cone structure described with respect to the corner assemblies 616. As seen in FIG. 20, which is a front perspective view of a portion of a further additional embodiment of the mountable article retaining system, a lag bolt 1340 is provided to cooperate with a right angled retaining washer 1342 in securing a respective corner of the mountable article retaining system to an external structure such as a vertical wall. As seen in FIG. 21, which is a front perspective view of the portion of the further additional embodiment of the mountable article retaining system shown in FIG. 20 in its installed disposition, the lag bolt 1340 extends through the retaining washer 1342 and has a tapered threaded end portion 1344 configured to threadingly engage, for example, the wall stud 726 of the structure wall 728. The retaining washer 1342 is compressively secured between the widened head of the lag bolt 1340 and the warp wires 620 and the weft wires 622 secured to a respective pair of paired bottom or top side wires 624 and upper side wires 626 and the retaining washer 1342 presses the open wire grid against the structure wall 728.

Figure 11:
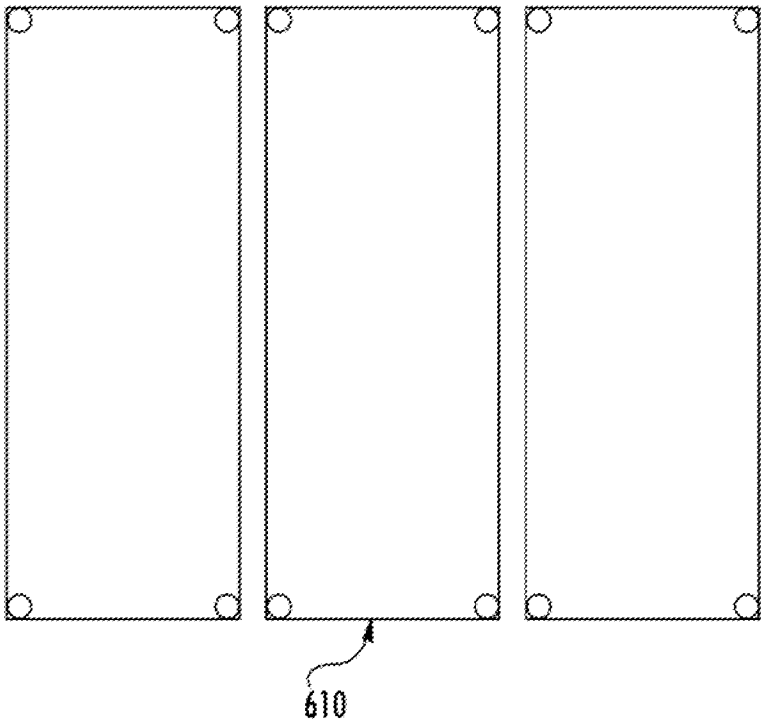
FIG. 11 is a front elevational view of a plurality of the mountable article retaining systems.
Figure 13:
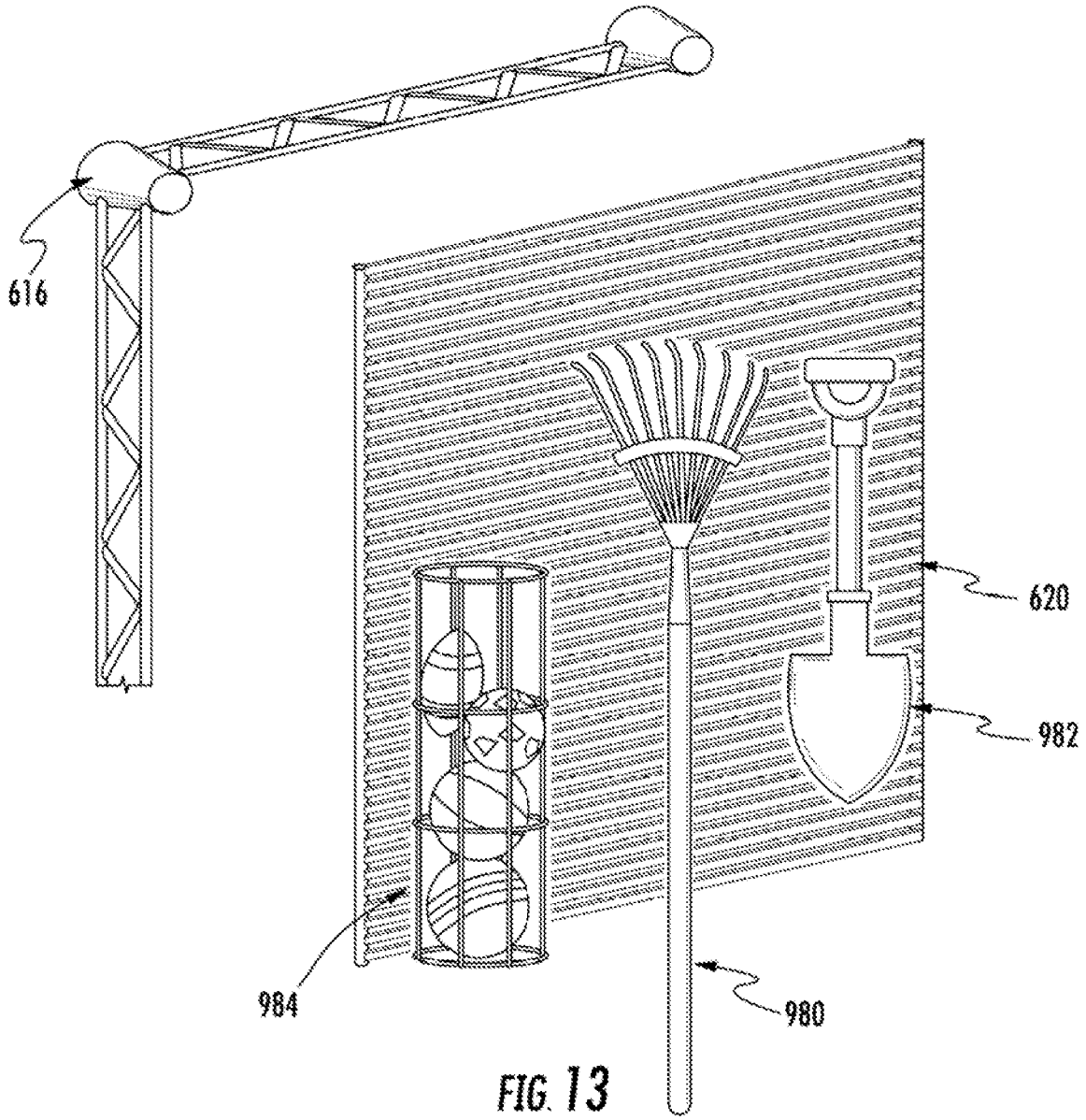
FIG. 13 is an exploded perspective view of the mountable article retaining system shown in FIG. 5 and showing a plurality of articles retained thereon.
Figure 14:
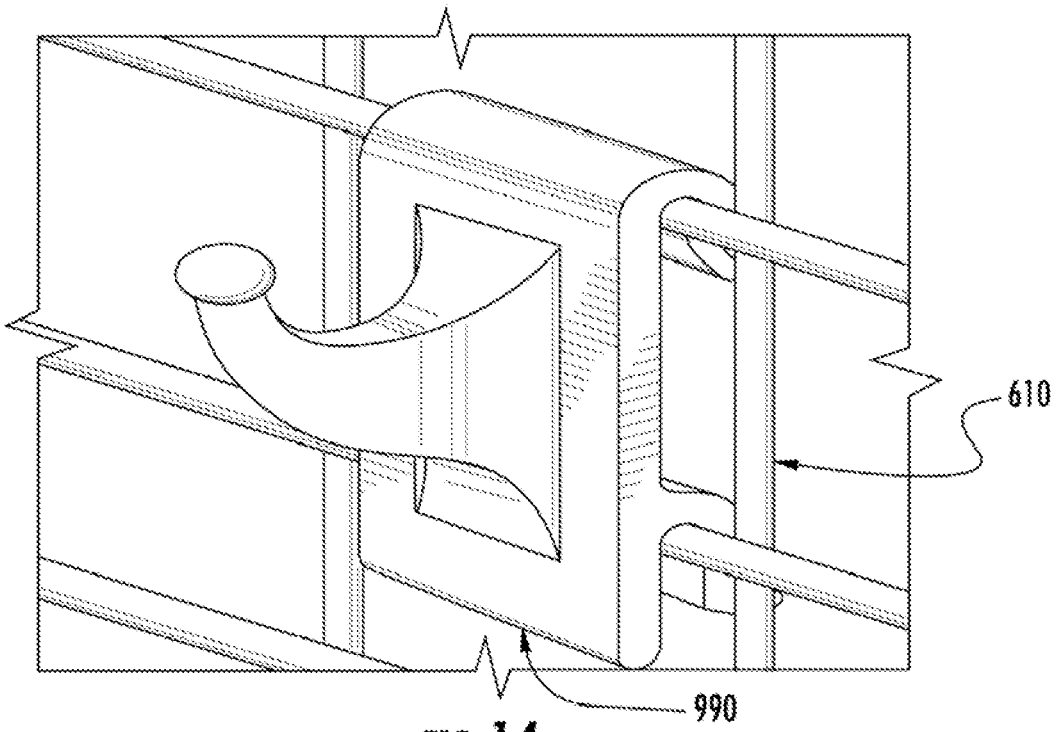
FIG. 14 is an enlarged perspective view of an attachment member for releasably interconnecting one of the articles shown in FIG. 13 secured to the mountable article retaining system.
Figure 15:
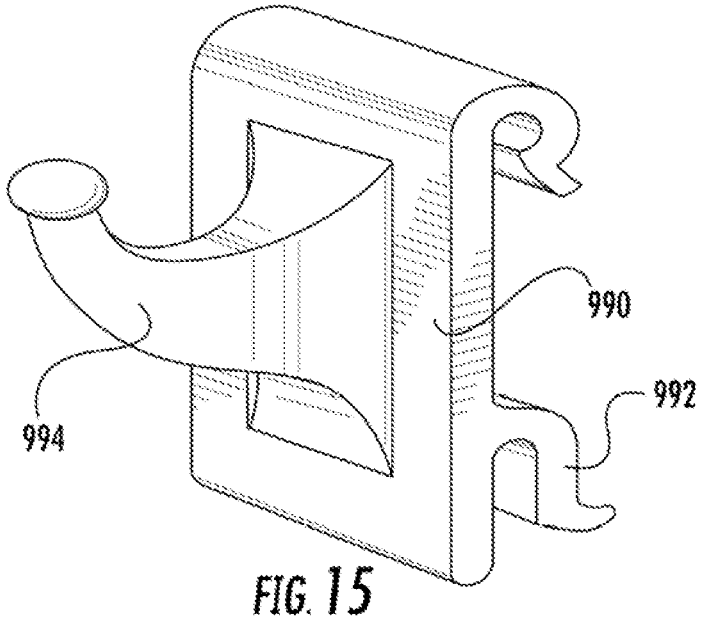
FIG. 15 is an enlarged perspective view of the attachment member shown in FIG. 14.
Figure 16:
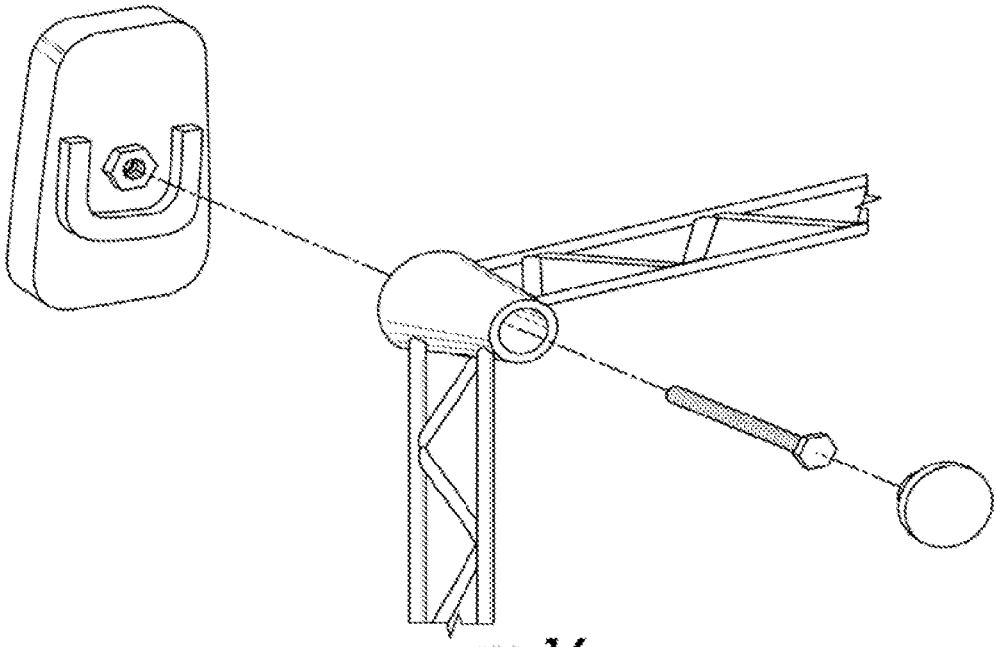
FIG. 16 is an enlarged exploded view of a single mounting bracket for mounting a corner assembly of the mountable article retaining system to an external structure.

As seen in FIG. 11, which is a front elevational view of a plurality of the mountable article retaining systems 610, the mountable article retaining systems 610 can be mounted in lateral alignment with one another on an external structure such as a wall to form an effective storage or display area for relatively larger articles, whereupon such larger articles can be retained via attachment members to several of the laterally aligned mountable article retaining systems 610. As seen in FIG. 13, which is an exploded perspective view of the mountable article retaining system shown in FIG. 5, a plurality of articles can be conveniently releasably interconnected via attachment members to the mountable article retaining system 610 such as a garden rake 980, a shovel 982, and a resin-covered wire cylinder 984 that retains soccer balls and other sport balls. As seen in FIG. 14, which is an enlarged perspective view of an attachment member for releasably interconnecting one of the articles shown in FIG. 13 secured to the mountable article retaining system, and seen in FIG. 15, which is an enlarged perspective view of the attachment member shown in FIG. 14, an attachment member 990 includes a pair of engaging clips 992 that each snap onto a respective warp or weft wire of the open wire grid of the mountable article retaining system 610 and a suspension hook 994 for engaging, for example, a cross wire of the resin-covered wire cylinder 984 that retains soccer balls and other sport balls. The attachment members can be formed via any suitable process such as, for example, casting, extrusion, molding, or stamping, and can be formed of any suitable material such as, for example, a metal, alloy, plastic, or polymer material.

The exemplary shapes, dimensions, wire sizes, number of shelves, and materials described herein are provided by way of example only. Wire grid rack systems fabricated in shapes, dimensions and using different wire sizes and materials and having a different number of shelves other than those discussed and illustrated herein also are contemplated.

Although this invention has been disclosed and described in its preferred forms with a certain degree of particularity, it is to be realized that the optimum dimensional relationships for the parts of the invention, to include variations in size, materials, shape, form, function and manner of operation, assembly and use, are deemed readily apparent and obvious to one skilled in the art. Additionally, it is understood that the present disclosure of the preferred forms is only by way of example and that numerous changes in the details of operation and in the combination and arrangement of parts may be resorted to without departing from the spirit and scope of the invention as hereinafter claimed.

What is claimed is:

1. A mountable article retaining system, the mountable article retaining system being operable to retain at least one article, the mountable article retaining system comprising:

a grid layout having an open wire grid, a plurality of corner assemblies secured to the open wire grid, a lateral set of side wire pairs having a first pair of associated side wires and a second pair of associated side wires, and a longitudinal set of side wire pairs having a first pair of associated side wires and a second pair of associated side wires, each corner assembly being connected to an end portion of a respective pair of associated side wires of the lateral set of side wires and an end portion of a respective pair of associated side wires of the longitudinal set of side wires, the open wire grid having a plurality of warp wires and a plurality of weft wires in substantially the same plane and arranged in perpendicular intersection manner with one another to delimit a rectilinear substantially planar suspension engagement area and four sides of the rectilinear substantially planar suspension engagement area formed by the plurality of warp wires and the plurality of weft wires being secured to the lateral set of side wires and the longitudinal set of side wires;

a liaison component, the liaison component being securable to an external structure on which the grid layout is to be mounted and the liaison component being operable to maintain the grid layout relative to the external structure such that the rectilinear substantially planar suspension engagement area of the grid layout has a non-horizontal slope with at least one of the corner assemblies being higher than another one of the corner assemblies;

each pair of associated side wires of the lateral set of side wires and each pair of associated side wires of the longitudinal set of side wires includes an upper side wire and a bottom side wire and further including a plurality of serpentine support trusses, each serpentine support truss being secured to the upper side wire and the lower side wire of each pair of associated side wires in a manner in which each top apex of the serpentine support truss is secured to the bottom side wire and each bottom apex of the serpentine support truss is secured to the upper side wire; and each corner assembly has a conical periphery having a first lateral hemisphere delimited by a cone lateral plane extending through a longitudinal axis of a corner assembly mid-point and perpendicular to an equator plane of the corner assembly and a second lateral hemisphere of the corner assembly delimited by the cone lateral plane and extending through the longitudinal axis of the corner assembly mid-point and perpendicular to the equator plane of the corner assembly, the upper side wire and the bottom side wire of the end portion of the respective pair of associated side wires of the lateral set of side wires connected to the corner assembly is connected to the corner assembly at a location along the conical periphery of the corner assembly within the first lateral hemisphere, and the upper side wire and the bottom side wire of the end portion of the respective pair of associated side wires of the longitudinal set of side wires connected to the corner assembly is connected to the corner assembly at a location along the conical periphery of the corner assembly within the second lateral hemisphere.

2. The mountable article retaining system according to claim 1, wherein the respective pair of associated side wires of the lateral set of side wires connected to each corner assembly and the respective pair of associated side wires of the longitudinal set of side wires connected to the corner assembly together form a wire set included angle having a value of ninety degrees (90°).

3. The mountable article retaining system according to claim 2, wherein each corner assembly has an annular bottom rim at one axial end and an annular top rim at its opposite axial end that has a diameter smaller than a diameter of the annular bottom rim.

4. The mountable article retaining system according to claim 3, wherein each corner assembly has a plate having a threaded center bore co-axial with the longitudinal axis of the corner assembly.

5. The mountable article retaining system according to claim 4, wherein the liaison component includes a liaison rail mountable on the external structure, the liaison rail having an attachment panel and a reinforcement panel extending perpendicularly from the attachment panel and secured to a longitudinal top edge portion of the attachment panel.

6. The mountable article retaining system according to claim 5, wherein the attachment panel has an offset center portion that extends intermediate to, and is connected to, the longitudinal top edge portion and a longitudinal bottom edge portion of the attachment panel and the offset center portion having a plurality of tapped bores each of which has one open end and a threaded inner surface.

7. The mountable article retaining system according to claim 6, wherein the liaison rail includes a plurality of wall attachment bores spaced apart along the length of the liaison rail at specific predetermined longitudinal spacings from one another for assisting with the secure attachment of the liaison rail to the external structure.

8. The mountable article retaining system according to claim 7 and further comprising an adapter boss provided at each location at which one of the corner assemblies is secured to the liaison rail, each adapter boss including a pedestal base having a shaped notch that is configured in correspondence with the offset center portion of the liaison rail such this shaped notch engages the offset center portion of the liaison rail to fix the pedestal base of the adapter boss in a non-rotating disposition relative to the offset center portion of the liaison rail, each adapter boss includes a center axis through bore, and the pedestal base of each adapter boss is of a larger diameter than the annular bottom rim of the corner assemblies, the pedestal base of each adapter boss is operable to be in abutting engagement with the annular bottom rim of one of the corner assemblies when the adapter boss is disposed intermediate the corner assembly and the liaison rail and further comprising a fastening bolt that (a) extends through, and threadingly engages, the threaded center bore of the plate of the corner assembly, (b) extends through the center axis through bore of the adapter boss, and (c) threadingly engages one of the tapped bores of the liaison rail to thereby ensure the fixed interconnection of the corner assembly and the liaison rail.

9. A mountable article retaining system, the mountable article retaining system being operable to retain at least one article, the mountable article retaining system comprising:

a grid layout having an open wire grid, a plurality of corner assemblies secured to the open wire grid, a lateral set of side stiffeners, and a longitudinal set of side stiffeners, each corner assembly being connected to an end portion of a respective one of the lateral side stiffeners and an end portion of a respective one of the longitudinal side stiffeners, the open wire grid having a plurality of warp wires and a plurality of weft wires in substantially the same plane and arranged in perpendicular intersecting manner with one another to delimit a rectilinear substantially planar suspension engagement area and four sides of the rectilinear substantially planar suspension engagement area formed by the plurality of warp wires and the plurality of weft wires being secured to the lateral set of side stiffeners and the longitudinal set of side stiffeners; and a liaison component, the liaison component being securable to an external structure on which the grid layout is to be mounted and the liaison component being operable to maintain the grid layout relative to the external structure such that the rectilinear substantially planar suspension engagement area of the grid layout has a substantially vertical slope with at least one of the corner assemblies being higher than another one of the corner assemblies.

10. A mountable article retaining system, the mountable article retaining system being operable to retain at least one article, the mountable article retaining system comprising:

a grid layout having an open wire grid, a plurality of corner assemblies secured to the open wire grid, a lateral set of side wire pairs having a first pair of associated side wires and a second pair of associated side wires, and a longitudinal set of side wire pairs having a first pair of associated side wires and a second pair of associated side wires, each corner assembly being connected to an end portion of a respective pair of associated side wires of the lateral set of side wires and an end portion of a respective pair of associated side wires of the longitudinal set of side wires, the open wire grid having a plurality of warp wires and a plurality of weft wires in substantially the same plane and arranged in perpendicular intersection manner with one another to delimit a rectilinear substantially planar suspension engagement area and four sides of the rectilinear substantially planar suspension engagement area formed by the plurality of warp wires and the plurality of weft wires being secured to the lateral set of side wires and the longitudinal set of side wires; and a liaison component, the liaison component being securable to an external structure on which the grid layout is to be mounted and the liaison component being operable to maintain the grid layout relative to the external structure such that the rectilinear substantially planar suspension engagement area of the grid layout has a substantially vertical slope with at least one of the corner assemblies being higher than another one of the corner assemblies.

11. The mountable article retaining system according to claim 10, wherein each pair of associated side wires of the lateral set of side wires and each pair of associated side wires of the longitudinal set of side wires includes an upper side wire and a bottom side wire and further including a plurality of serpentine support trusses, each serpentine support truss being secured to the upper side wire and the lower side wire of each pair of associated side wires in a manner in which each top apex of the serpentine support truss is secured to the bottom side wire and each bottom apex of the serpentine support truss is secured to the upper side wire.

12. The mountable article retaining system according to claim 11, wherein each corner assembly has a conical periphery having a first lateral hemisphere delimited by a cone lateral plane extending through a longitudinal axis of a corner assembly mid-point and perpendicular to an equator plane of the corner assembly and a second lateral hemisphere of the corner assembly delimited by the cone lateral plane and extending through the longitudinal axis of the corner assembly mid-point and perpendicular to the equator plane of the corner assembly, the upper side wire and the bottom side wire of the end portion of the respective pair of associated side wires of the lateral set of side wires connected to the corner assembly is connected to the corner assembly at a location along the conical periphery of the corner assembly within the first lateral hemisphere, and the upper side wire and the bottom side wire of the end portion of the respective pair of associated side wires of the longitudinal set of side wires connected to the corner assembly is connected to the corner assembly at a location along the conical periphery of the corner assembly within the second lateral hemisphere.

13. The mountable article retaining system according to claim 12, wherein the respective pair of associated side wires of the lateral set of side wires connected to each corner assembly and the respective pair of associated side wires of the longitudinal set of side wires connected to the corner assembly together form a wire set included angle having a value of ninety degrees (90°).

14. The mountable article retaining system according to claim 13, wherein each corner assembly has an annular bottom rim at one axial end and an annular top rim at its opposite axial end that has a diameter smaller than a diameter of the annular bottom rim.

15. The mountable article retaining system according to claim 14, wherein each corner assembly has a plate having a threaded center bore co-axial with the longitudinal axis of the corner assembly.

16. The mountable article retaining system according to claim 15, wherein the liaison component includes a liaison rail mountable on the external structure, the liaison rail having an attachment panel and a reinforcement panel extending perpendicularly from the attachment panel and secured to a longitudinal top edge portion of the attachment panel.

17. The mountable article retaining system according to claim 16, wherein the attachment panel has an offset center portion that extends intermediate to, and is connected to, the longitudinal top edge portion and a longitudinal bottom edge portion of the attachment panel and the offset center portion having a plurality of tapped bores each of which has one open end and a threaded inner surface.

18. The mountable article retaining system according to claim 17, wherein the liaison rail includes a plurality of wall attachment bores spaced apart along the length of the liaison rail at specific predetermined longitudinal spacings from one another for assisting with the secure attachment of the liaison rail to an external structure.

19. The mountable article retaining system according to claim 18 and further comprising an adapter boss provided at each location at which one of the corner assemblies is secured to the liaison rail, each adapter boss including a pedestal base having a shaped notch that is configured in correspondence with the offset center portion of the liaison rail such this shaped notch engages the offset center portion of the liaison rail to fix the pedestal base of the adapter boss in a non-rotating disposition relative to the offset center portion of the liaison rail, each adapter boss includes a center axis through bore, and the pedestal base of each adapter boss is of a larger diameter than the annular bottom rim of a corner assembly, the pedestal base of each adapter boss is operable to be in abutting engagement with the annular bottom rim of one of the corner assemblies when the adapter boss is disposed intermediate the corner assembly and the liaison rail and further comprising a fastening bolt that (a) extends through, and threadingly engages, the threaded center bore of the plate of the corner assembly, (b) extends through the center axis through bore of the adapter boss, and (c) threadingly engages one of the tapped bores of the liaison rail to thereby ensure the fixed interconnection of the corner assembly and the liaison rail.

20. A mountable article retaining system, the mountable article retaining system being operable to retain at least one article, the mountable article retaining system comprising:

a grid layout having an open wire grid, a plurality of corner assemblies secured to the open wire grid, a lateral set of side stiffeners, and a longitudinal set of side stiffeners, each corner assembly being connected to an end portion of a respective one of the lateral side stiffeners and an end portion of a respective one of the longitudinal side stiffeners, the open wire grid having a plurality of warp wires and a plurality of weft wires in substantially the same plane and arranged in perpendicular intersecting manner with one another to delimit a rectilinear substantially planar suspension engagement area and four sides of the rectilinear substantially planar suspension engagement area formed by the plurality of warp wires and the plurality of weft wires being secured to the lateral set of side stiffeners and the longitudinal set of side stiffeners; and a liaison component, the liaison component being securable to a substantially vertical wall on which the grid layout is to be mounted and the liaison component being operable to maintain the grid layout relative to the wall such that the rectilinear substantially planar suspension engagement area of the grid layout has a substantially vertical slope with at least one of the corner assemblies being higher than another one of the corner assemblies;

the open wire grid extending a predetermined distance from the wall.

* * * * *